US011756393B2

(12) United States Patent
Zhang et al.

(10) Patent No.: US 11,756,393 B2
(45) **Date of Patent: *Sep. 12, 2023**

(54) ALARMING PRODUCT SECURITY DEVICE

(71) Applicant: EDGE SECURITY PRODUCTS LLC, Waxhaw, NC (US)

(72) Inventors: Ningsheng Zhang, Waxhaw, NC (US); David P. Christianson, Charlotte, NC (US)

(73) Assignee: EDGE SECURITY PRODUCTS LLC, Waxhaw, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/574,083

(22) Filed: Jan. 12, 2022

(65) Prior Publication Data

US 2022/0139178 A1 May 5, 2022

Related U.S. Application Data

(63) Continuation of application No. 16/527,481, filed on Jul. 31, 2019, now Pat. No. 11,250,677.

(60) Provisional application No. 62/736,333, filed on Sep. 25, 2018, provisional application No. 62/713,110, filed on Aug. 1, 2018.

(51) Int. Cl.
*G08B 13/06* (2006.01)
*G08B 13/24* (2006.01)

(52) U.S. Cl.
CPC ..... *G08B 13/06* (2013.01); *G08B 13/2434* (2013.01); *G08B 13/2482* (2013.01)

(58) Field of Classification Search
CPC .. E05B 45/005; E05B 67/003; E05B 73/0017; G06K 19/0723; G06K 19/07773; G06K 19/07758; G08B 13/06; G08B 13/1463; G08B 13/1654; G08B 13/242; G08B 13/246; G08B 13/2417; G08B 13/2434; G08B 13/2482; G08B 25/10
USPC ..... 340/572.1
See application file for complete search history.

(56) References Cited

U.S. PATENT DOCUMENTS

| | | | | |
|---|---|---|---|---|
| 9,852,596 | B2 | 12/2017 | Mexis | |
| 2003/0197611 | A1* | 10/2003 | Clifford | G08B 13/242 340/572.1 |
| 2005/0275537 | A1 | 12/2005 | Kerr et al. | |
| 2006/0137411 | A1 | 6/2006 | Fawcett et al. | |
| 2007/0080806 | A1 | 4/2007 | Lax et al. | |
| 2008/0316028 | A1 | 12/2008 | Conti et al. | |
| 2010/0171619 | A1 | 7/2010 | Hall | |

(Continued)

*Primary Examiner* — Stephen R Burgdorf
(74) *Attorney, Agent, or Firm* — BURR & FORMAN LLP

(57) ABSTRACT

A security device is provided that includes an electronic article surveillance tag that may be configured to resonate to provide a wireless response signal to a deactivator to trigger generation of a deactivation field. Further, the security device may include tamper detection circuitry which may include a tamper sensor configured to generate a tamper signal in response to detecting a tamper event, a deactivation sensor configured to generate a deactivation signal in response to detecting the deactivation field, and a sounder. In this regard, the tamper detection circuitry may be configured to deactivate the tamper detection circuitry in response to receiving the deactivation signal from the deactivation sensor such that receipt of the tamper signal after deactivation of the tamper detection circuitry does not trigger the sounder to emit the alarm.

20 Claims, 28 Drawing Sheets

(56) References Cited

U.S. PATENT DOCUMENTS

| | | | |
|---|---|---|---|
| 2010/0171621 | A1 | 7/2010 | Yang |
| 2011/0074582 | A1 | 3/2011 | Alexis |
| 2011/0232392 | A1 | 9/2011 | Suess |
| 2012/0187003 | A1 | 7/2012 | Stewart et al. |
| 2013/0105584 | A1 | 5/2013 | Forster |
| 2017/0162014 | A1 | 6/2017 | Zhang |
| 2019/0206212 | A1* | 7/2019 | Forster ..... G06K 19/07372 |

* cited by examiner

ALARMING PRODUCT SECURITY DEVICE

CROSS REFERENCE TO RELATED APPLICATIONS

This application is a continuation of U.S. application Ser. No. 16/527,481 filed on Jul. 31, 2019, which claims priority to U.S. application No. 62/713,110 filed Aug. 1, 2018 and U.S. application No. 62/736,333 filed Sep. 25, 2018, the entire contents of which are hereby incorporated by reference in their entirety.

TECHNICAL FIELD

Example embodiments generally relate to security technology and, in particular, relate to security devices that include audible alarming features and can be attached to an item to provide security for the item.

BACKGROUND

Frequently in retail settings, product security tags and other devices attached to products or product packaging are commonly used to deter and intercept theft activities. Such devices operate to deter theft by notifying retailers that a theft event may be occurring. Many systems that are utilized in a retail setting, often referred to as electronic article surveillance (EAS) systems, use pedestals or towers located at the exits of a retail establishment that include antennas for detecting RF signals emitted by a product security device that is affixed to a product for sale. Such product security devices can be either disposable or reusable. Disposable devices may be affixed to a product permanently as a one-time-use device that is deactivated at the POS and leaves the retail store with the purchasing customer. On the other hand, a reusable device may be removably locked to the product and can be unlocked and separated from the product at the POS. As such, the reusable security device may stay in the retail store to be applied to another product for sale to repeat the process. If a security device does not pass through the POS to either be deactivated or removed, then the existence of an active device on the product can be detected by the EAS system antennas at the exits of the retail store and cause an alarm to sound.

The removal or deactivation of such security devices continues to be an issue with retail establishments. Retailers are continually working to improve customer experience which includes minimizing or eliminating queuing and wait times at the POS. The time required to remove a security device can add to the queue time leading to delays and a less desirable customer experience. Additionally, such security devices can pose issues for self-checkout POS systems as well because special keys are processes are often required to remove the products from the product.

For example, many reusable security devices require application of a key, often a magnetic key, to remove the security device from the product at the POS without sounding an alarm. Application of the key can increase the time needed to, for example, remove the security device. Additionally, such security devices may require only a magnetic key for removal, which can create weaknesses in the security approach. For example, such magnetic keys may be fabricated or stolen thereby creating the risk that such keys can be used by thieves in an unmonitored or "dark" area of the store to remove the security devices from the products and then simply carry the products through the EAS systems at the exits without detection.

As such, there continues to be a need for improvement in the area of product security devices. In particular, there is a need for security devices that increase the efficiency of the POS queue and also offer additional degrees of security features beyond what is offered by, for example, a magnetic key-based locking mechanism.

BRIEF SUMMARY OF SOME EXAMPLES

According to some example embodiments, a security device is provided. The security device may comprise a housing, an article surveillance tag, and tamper detection circuitry. The electronic article surveillance tag may be disposed in the housing, and may be configured to resonate to provide a wireless response signal to a deactivator to trigger generation of a deactivation field by the deactivator and resonate to provide the wireless signal to a gate to trigger a gate alarm in response to a gate field. The tamper detection circuitry may be disposed within the housing, and the tamper detection circuitry may comprise a tamper sensor configured to generate a tamper signal in response to detecting a tamper event, a deactivation sensor configured to generate a deactivation signal in response to detecting the deactivation field, and a sounder. In this regard, the tamper detection circuitry may be configured to trigger the sounder to emit an alarm sound in response to receiving the tamper signal from the tamper sensor when the tamper detection circuitry, and deactivate the tamper detection circuitry in response to receiving the deactivation signal from the deactivation sensor such that receipt of the tamper signal after deactivation of the tamper detection circuitry does not trigger the sounder to emit the alarm.

According to some example embodiments, a security device is provided. The security device may comprise a housing, an article surveillance tag, and tamper detection circuitry. The electronic article surveillance tag may be disposed in the housing, and may be configured to resonate to provide a wireless response signal to a deactivator to trigger generation of a deactivation field by the deactivator and resonate to provide the wireless signal to a gate to trigger a gate alarm in response to a gate field. The tamper detection circuitry may be disposed within the housing, and the tamper detection circuitry may comprise a tamper sensor configured to generate a tamper signal in response to detecting a tamper event, a deactivation sensor configured to generate a deactivation signal in response to detecting the deactivation field, and a sounder. The tamper event may be a severing of a conductive strip that is electrically connected to the tamper sensor to form a loop. In this regard, the tamper detection circuitry may be configured to trigger the sounder to emit an alarm sound in response to receiving the tamper signal from the tamper sensor when the tamper detection circuitry, and deactivate the tamper detection circuitry in response to receiving the deactivation signal from the deactivation sensor such that receipt of the tamper signal after deactivation of the tamper detection circuitry does not trigger the sounder to emit the alarm. Further, the electronic article surveillance tag and the deactivation sensor may be tuned to a frequency of the deactivation field.

According to some example embodiments, a method is provided. The method may include resonating, by an electronic article surveillance tag disposed within a housing of a security device, to provide a wireless response signal to a deactivator to trigger generation of a deactivation field by the deactivator. The method may further include receiving, by the electronic article surveillance tag, the deactivation field from a deactivator, and simultaneously receiving, by a deactivation sensor disposed within the housing of the security device, the deactivation field. The method may also include in response to simultaneously receiving the deactivation field by the deactivation sensor, deactivating tamper detection circuitry of the security device such that receipt of a tamper signal after deactivation of the tamper detection circuitry does not trigger a sounder to emit the alarm.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
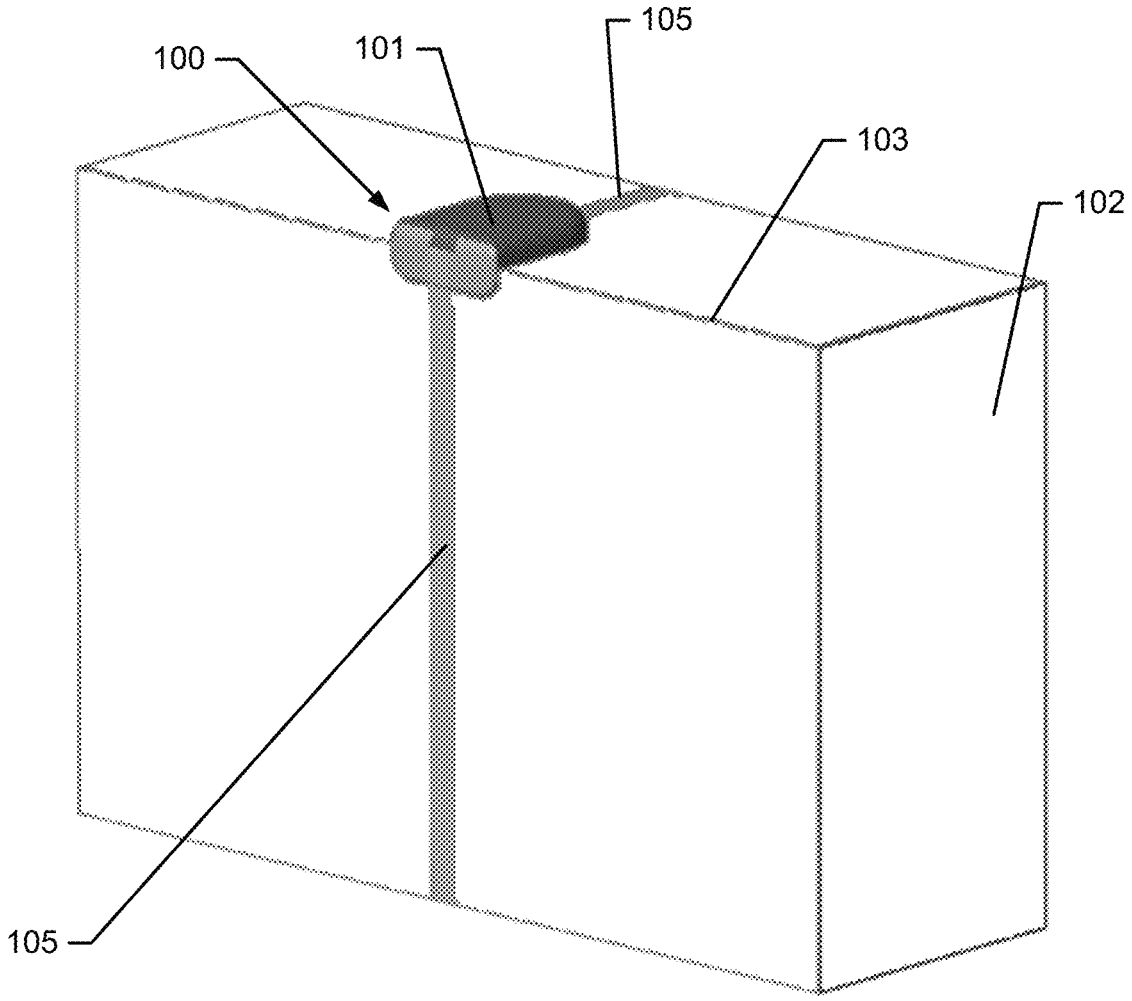
FIG. 1 illustrates an example security device affixed to an item according to some example embodiments.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. As used herein, operable coupling should be understood to relate to direct or indirect connection that, in either case, enables functional interconnection of components that are operably coupled to each other.

Among other example embodiments, an example security device is provided herein that includes both local alarming anti-tamper features, in addition to being deactivatable at, for example, a point-of-sale (POS) via a deactivator. The example security device may be comprised of an alarming unit and peripheral components that can assist with affixing the alarming unit to a product or extending the anti-tamper functions of the alarming unit. According to some example embodiments, the example security device may be embodied as a one-time-use, disposable device that can be deactivated at the POS and leave the retail establishment with the purchased product. Accordingly, no removal of the alarming unit by store personnel may be required. However, according to some example embodiments, the security device may alternatively be implemented in manner where the device is removed and reusable within the retail establishment. In this regard, the security device may be removable from the product after being deactivated to disable the anti-tamper features. After being deactivated, removal may be performed, for example, via a magnetic key, a push button, or the like, and the alarming unit may be removed from the product and reused on another product for sale within the retail establishment.

According to some example embodiments, the example security device may include an electronic article surveillance (EAS) tag. The EAS tag may be deactivatable (e.g., for a disposable security device) or non-deactivatable (e.g., for a reusable security device). As a deactivatable EAS tag, the tag may be deactivated (e.g., permanently) such that the tag no longer operates to trigger an alarm by an alarming gate at the exits of a retail establishment thereby allowing a customer to leave the store with the tag, after deactivation, and not trigger the alarm. As a non-deactivatable EAS tag, the tag cannot be deactivated and would be included in a reusable security device that does not leave the retail establishment, but is repeatedly reused after the product to which the security device is attached is sold. The EAS tag may be a radio frequency (RF) label (e.g., resonant at 8.2 or 4.8 MHz) or an acousto-magnetic tag (e.g., resonant at 58 kHz). As mentioned above, the EAS tag may be configured to resonate and return a signal to, for example, an EAS gate when exposed to an electromagnetic field generated by the gate (i.e., a gate field) at the resonant frequency of the EAS tag. The EAS gate, for example, may be located at the exit of a retail store. Upon detecting the EAS tag's return signal, the EAS gate may trigger a gate alarm to indicate that a possible theft may be occurring and alert store personnel.

In example embodiments where the security device is disposable, a deactivatable EAS tag may be used, which may be deactivated at a POS in association with the successful purchase of a product to which the security device is affixed. In this regard, the POS may include a deactivator device that may be incorporated into, for example, a deactivator pad. Alternatively, such a deactivator may be incorporated into various devices that may include the deactivator as a component, such as devices with an integrated barcode scanning device, and RFID reader, or a deactivator wand. The deactivator may be configured to output a wireless signal at, for example, the resonant frequency of the deactivatable EAS tag. Upon detecting the presence of an EAS tag within the deactivator field at the POS (e.g., deactivatable or non-deactivatable), due to receipt of a return signal from the EAS tag, the deactivator may be configured to increase the power of the deactivator field to attempt to deactivate the EAS tag. The increased power of the deactivator field may operate to deactivate a deactivatable EAS tag, for example, by increasing a current in an RF resonant circuit of an RF deactivatable EAS tag to breakdown the dielectric between the plates of a capacitor (e.g., a location of an dimple in the dielectric) and cause a short between the plates thereby preventing further resonating of the deactivatable EAS tag after being exposed to the deactivation field. Alternatively, the increased power of the deactivator signal may operate to change the magnetism in a metal strip within an AM deactivatable EAS tag thereby preventing the AM EAS tag from further resonating due to the induced change in magnetism of the metal strips within the tag. As such, the deactivation field generated by the deactivator may be output a higher power than the gate field, with the increased power causing the deactivation. However, the deactivation field and the gate field may be generated at a same signal frequency. In an instance in which the EAS tag is non-deactivatable, the deactivator may be configured to output the higher power field, however, the EAS tag may not deactivate. Nonetheless, the higher power deactivation field triggered by the presence of an EAS tag in the deactivator field may be useful for other purposes with respect to tamper detection circuitry as further described herein.

In addition to the EAS tag, the example security device may include tamper detection circuitry within the alarming unit that is configured to implement an anti-tamper feature having a local audible alarm. In this regard, the tamper detection circuitry may include a tamper sensor that may be implemented in a number of forms. For example, according to some example embodiments, the tamper sensor may include contacts that may be affixed to a conductive strip that can be monitored for connectivity. A breaking or severing of the conductive strip may constitute a tamper event that is detected by the tamper sensor, and the tamper detection circuitry may be configured to trigger an audible alarm in response to a tamper signal provided by the tamper sensor in response to the tamper event. Additionally or alternatively, the tamper sensor may include a tamper switch (e.g., a plunger switch) that is positioned to detect that the alarming unit is in contact with the product. A change in the state of the tamper switch, e.g., due to movement of the alarming unit away from the product, may be another type of tamper event that generates a tamper signal to trigger the tamper detection circuitry to emit an audible alarm.

More specifically, with respect to monitoring a conductive strip, the example security device may include tamper detection circuitry that monitors, for example, a conductive strip that forms a loop that may be wrapped around an item to secure the item physically and with an alarming feature. According to some example embodiments, the conductive strip may include an adhesive that affixes the conductive strip to the item to, for example, prevent flaps of the box from being opened. Further, the conductive strip may be connected to the example security device at both ends to form a loop that may be monitored for connectivity via a tamper sensor. As such, the example security device may be configured to monitor the connectivity of the conductive strip, and if the conductive strip is severed (e.g., due to the conductive strip being cut in an attempt to open the product packaging or in an attempt to otherwise separate an alarming unit of the example security device from the product), then the tamper detection circuitry may trigger a sense loop alarm, local to the example security device, to, for example, audibly alert store personnel of a possible theft.

According to some example embodiments, the tamper detection circuitry that supports the tamper sensor and alarming functionalities may also include a deactivation sensor that operates to permit the tamper detection and alarming features of the security device to be selectively deactivated, for example, permanently for a disposable security device or temporarily for a reusable security device. In this regard, the deactivation sensor may include a deactivation field-controlled switch, and may use operation of the switch to generate a deactivation signal. In this regard, the deactivation sensor may be operable to deactivate the tamper detection circuitry to prevent, for example, an audible alarm from occurring after deactivation of the tamper detection circuitry. As such, where the example security device is disposable, deactivation of the tamper detection circuitry and the deactivatable EAS tag via a deactivator may permit the security device to leave the retail environment with the purchasing customer and without either the deactivatable EAS tag or the tamper detection circuitry sounding an alarm. Alternatively, where the example security device is reusable, deactivation of the tamper detection circuitry may permit the alarm unit of the security device to be removed from the product, without triggering an audible alarm.

According to some example embodiments, the deactivation sensor may be operated to deactivate the tamper detection circuitry's ability to trigger the audible alarm in response to receipt of a deactivation field from a deactivator.

Further, the deactivation sensor may be configured to operate to provide an output in the form of a deactivation signal (e.g., opening a switch or generating a high resistance state) in response to receiving or being present within the deactivation field generated by the deactivator. As such, in an example embodiment that is a disposable security device, interaction with the deactivator at the POS may permit both the deactivatable EAS tag and the tamper detection circuitry to be deactivated rendering the security device disposable.

According to some example embodiments, the deactivation sensor may comprise a reed switch, having reeds that may deflect to contact each other to close the switch, or deflect away from each other such that the reeds do not contact to open the switch. The deactivation sensor may also include magnetizable strips, for example, disposed on opposite sides of the reed switch. If the magnetizable strips are properly magnetized, the reeds of the switch may be affected by the fields generated by the magnetizable strips and the reeds may be urged into contact with each other to close the switch. In response to the switch being closed, the tamper detection circuitry may be in an active state to permit triggering of the sense loop alarm if the conductive strip is severed. However, if the deactivation sensor, and more particularly magnetizable strips, are demagnetized due to the exposure to the deactivator field, then the reeds may open and the tamper detection circuitry may be deactivated and not sound the sense loop alarm if the conductive strip is severed.

The deactivation sensor may also be embodied by other devices that can perform a switching-type operation in response to receipt of the deactivator field. In this regard, for example, other types of sensors that comprise an antenna (e.g., an inductor) or a resonant circuit may be configured to detect the deactivator field. Alternatively, other, for example, thin-film devices may be components of a deactivation sensor such as a tunnel-magnetoresistance (TMR) sensor.

Accordingly, example embodiments provide for a security device that includes both local alarming features for use within the retail store, and also deactivation features which permit the security device to be disposable or reusable. The inclusion of the deactivation sensor offers the advantage of permitting the alarming security device to be completely deactivatable and therefore disposable (i.e., can leave the store with a properly purchased product). Alternatively, the security device may include tamper detection circuitry that is temporarily deactivatable, via a deactivation field intended for a deactivatable EAS tag, for use in a reusable security device. In other words, some example embodiments of the security device are deactivatable using the same deactivator as the deactivatable EAS tag, thereby permitting the tamper detection circuitry to be deactivated without introducing a unique deactivator for the tamper detection circuitry and without introducing new procedures for store personnel to perform a deactivation of a security device at the POS.

In accordance with some example embodiments, FIG. 1 illustrates an example security device 100 affixed to an item 102. The example security device 100 may be configured to a disposable or reusable security device. In this regard, the security device 100 may include an alarming unit 101 and, for example, a conductive strip 105. The alarming unit 101 may, for example, be affixed to the item 102 along an edge 103. Alternatively, the alarming unit 101 may be affixed to the item 102 at a position away from the edge 103 or any other edge of the item 102 or internal to the enclosure of the item 102. Further, the conductive strip 105 may loop around the item 102 and be connected at each end to electrical contacts of the alarming unit 101 to form an electric circuit or sense loop through the conductive strip 105 back to the alarming unit 101. The conductive strip 105 may include at least a conductor such as aluminum thread that is continuously connected throughout the length of the conductive strip 105. The conductive strip 105 may be affixed to the item 102 via an adhesive. According to some example embodiments, the conductive strip 105 may include an adhesive backing (e.g., adhesive tape) with a conductor affixed thereto via the adhesive, where the conductor extends along a length of the conductive strip 105 and is exposed for electrical connection on an adhesive side of the backing. In this regard, for example, the conductor may be affixed to the backing such that the conductor is exposed to form an electrical connection on a first side of the backing and insulated from forming an electrical connection on a second side of the backing. The alarming unit 101 may be configured to electrically connect to the conductive strip 105, monitor the connectivity of the conductive strip 105, and trigger a sense loop alarm if a discontinuity is introduced to the conductive strip 105.

Figure 2:
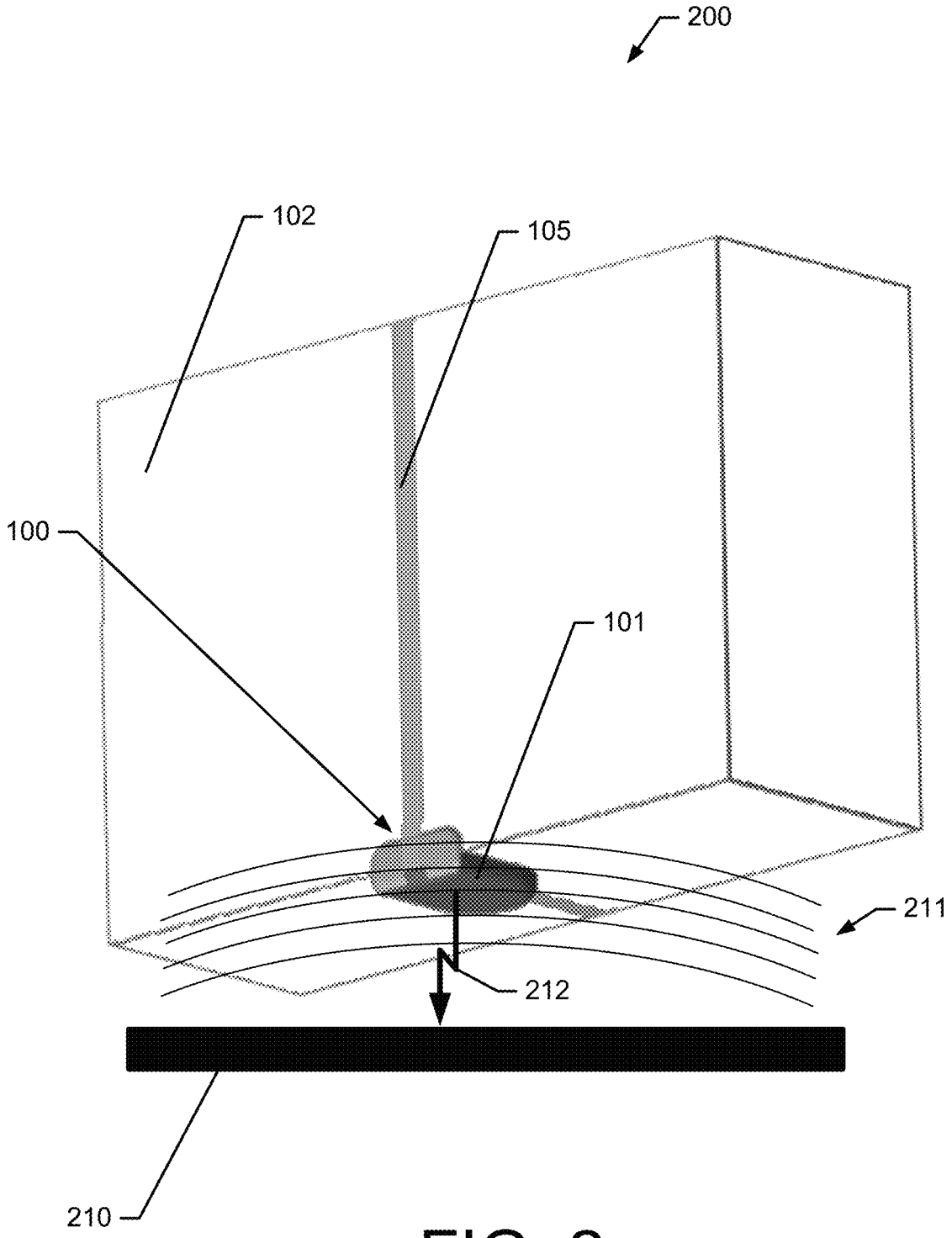
FIG. 2 illustrates an example system including a security device and a deactivator generating a deactivation field according to some example embodiments.

FIG. 2 illustrates an example system 200 including a security device 100 and a deactivator 210 generating a deactivation field 211 according to some example embodiments. As such, the security device 100 is being subjected to the deactivator field 211, presumably at a POS. As a result, in example embodiments where the EAS tag is deactivatable (e.g., the security device 100 is disposable), both the deactivatable EAS tag of the security device 100 and the tamper detection circuitry of the security device 100 may be deactivated by the deactivator field 211. Alternatively, in example embodiments where the EAS tag is non-deactivatable (e.g., the security device 100 is reusable), the presence of the non-deactivatable EAS tag still sends a response signal 212 back to the deactivator 210 to generate the deactivation field 211, and the tamper detection circuitry is deactivated to permit removal of the alarming unit 101 without triggering an audible alarm. The deactivator field 211 may be provided by the deactivator in response to detecting the presence of the deactivatable or non-deactivatable EAS tag of the security device 100. However, the same deactivator field 211 may be used to deactivate both the EAS tag, in instances in which the EAS tag is deactivatable, and the tamper detection circuitry. According to some example embodiments, the tamper detection circuitry may be configured to deactivate in response to receipt or detection of a deactivation field that exceeds a threshold power level. Further, the deactivation field may be generated at a given frequency such as, for example, 8.2 or 4.8 MHz for an RF deactivator system or 58 kHz for an AM deactivator system.

Figure 3A:
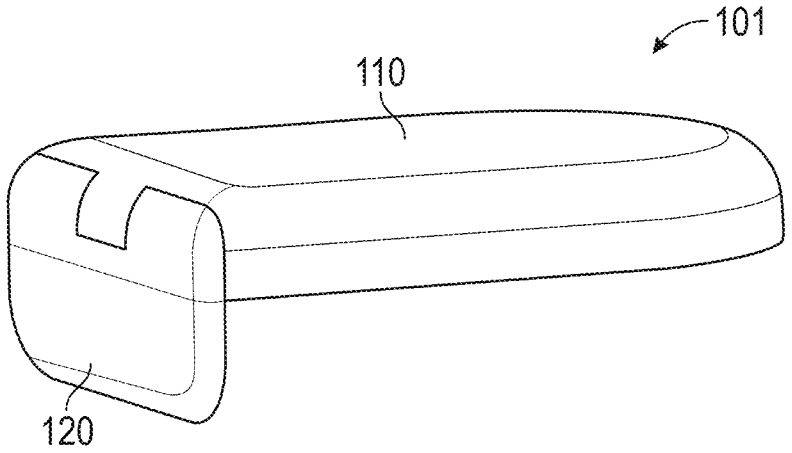
FIGS. 3A and 3B illustrate perspective views of an example alarming unit of a security device according to some example embodiments.
Figure 3B:
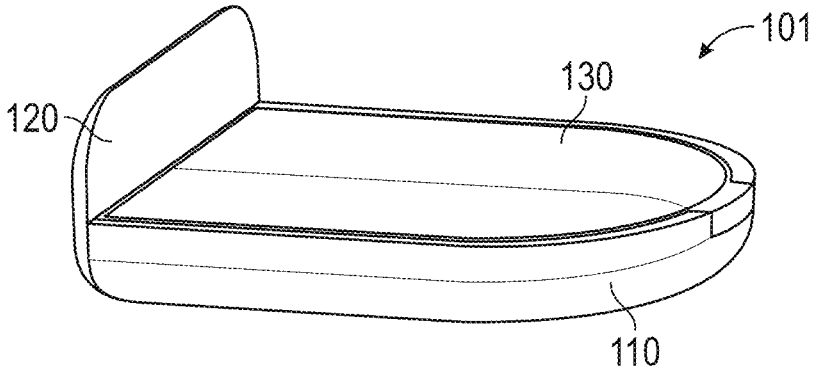
Figure 4A:
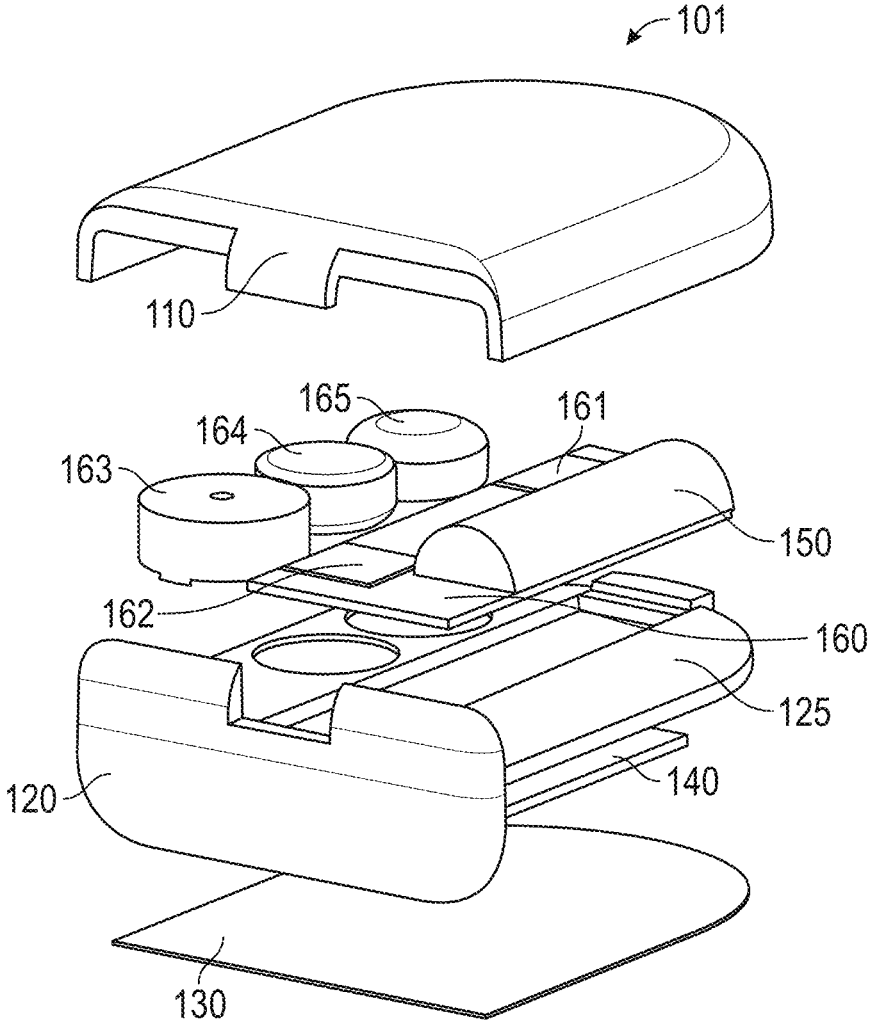
FIG. 4A illustrates an exploded view of an example alarming unit of a security device according to some example embodiments.
Figure 4B:
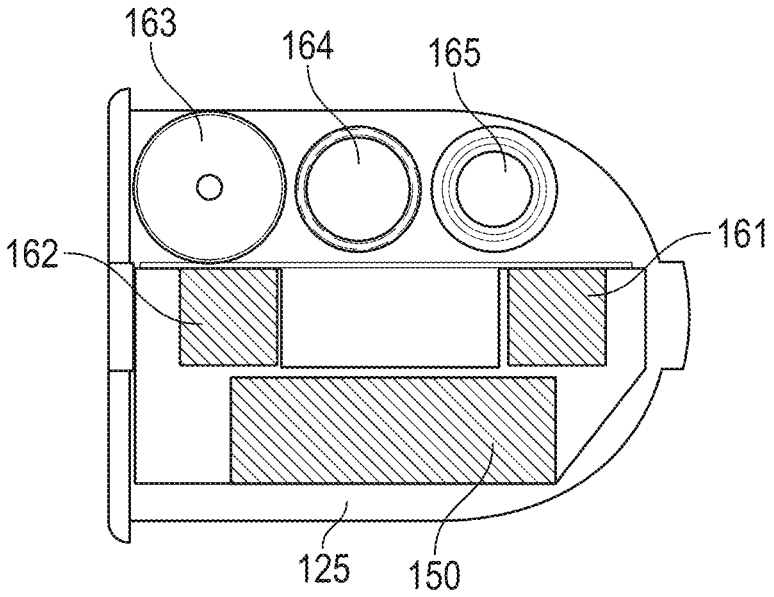
FIG. 4B illustrates a top view of an example alarming unit with a top cover removed according to some example embodiments.

FIGS. 3A and 3B illustrate perspective views of the example alarming unit 101 of a security device 100 according to some example embodiments. In this regard, the alarming unit 101 may include an edge plate 120 that extends at a right angle to a top housing portion 110 to facilitate affixing the security device 100 on an edge of the item to be protected. According to some example embodiments, the alarming unit 101 need not include an edge plate 120 to facilitate placement of the alarming unit 101 at locations, other than at an edge. Also with reference to the exploded view of the alarming unit 101 of FIG. 4A, the security device 100 may include the top housing portion 110 and a bottom housing portion 125. In this regard, FIG. 4B shows a top view of the alarming unit 101 with the top housing portion 110 removed. According to some example embodiments, the bottom housing portion 125 may include the edge plate 120. Further, the alarming unit 101 may also include a EAS tag 140, which may be a deactivatable or non-deactivatable radio frequency (RF) label or an acousto-magnetic (AM) tag. Further, the alarming unit 101 may also comprise a printed circuit board (PCB) 160, conductive strip contacts 161 and 162 for connecting to the conductive strip 105, a deactivation sensor 150, batteries 164 and 165, and a sounder 163 (e.g., piezo buzzer, speaker, or the like). The security device 100 may also include an adhesive 130 (e.g., in the form of an adhesive pad), which may comprise a pressure sensitive adhesive (PSA). In this regard, the adhesive 130 may be used to affix the alarming unit 101 to product packaging. The conductive strip contacts 161 and 162, the deactivation sensor 150, the batteries 164 and 165, and the sounder 163 may be populated on the PCB 160 and, where necessary, electrically connected to support operation as described herein.

Having described aspects of some example embodiments of a security device as provided with respect to FIGS. 1 to 4B, FIG. 5 illustrates a functional block diagram of another security device 200 in accordance with some example embodiments. The security device 100 may be an example embodiment of the security device 200. In this regard, the security device 200 may comprise a housing 201 for an alarming unit of the security device 200, within which an EAS tag 205 and tamper detection circuitry 202 may be disposed. The housing 201 may be an enclosure that the EAS tag 205 and the tamper detection circuitry 202 are disposed within, and can be affixed to product packaging via, for example, an adhesive. According to some example embodiments, the housing 201 may be formed of, for example, plastic and may comprise components, such as, top housing portion 110 and bottom housing portion 125 to form the housing 201.

The EAS tag 205 may be the same or similar to the EAS tag 140 described above. Further, according to some example embodiments, the EAS tag 205 may be disposed within the housing 201 and configured to resonate to provide a wireless response signal in response to a being disposed within a gate field. In this regard, the EAS tag 205 may be a resonator configured to provide a return wireless signal in response to receiving a signal at a resonant frequency for the EAS tag 205. As such, when the EAS tag 205 is subjected to an electromagnetic field generated by, for example, an EAS security gate, the EAS tag 205 may become excited and resonate, thereby causing a response signal to be generated by the EAS tag 205. Further, when the EAS tag 205 is subjected to a "sense" field or an interrogation field provided by a deactivator, the EAS tag 205 may be configured to resonate and provide a wireless response signal. Based on receipt of the response signal from the EAS tag 205, the deactivator may be configured to increase the power of the field from the sense field to a deactivation field that attempts to deactivate the EAS tag 205. If the EAS tag 205 is a deactivatable EAS tag, then the deactivation field may operate to deactivate the EAS tag 205. If the EAS tag 205 is a non-deactivatable EAS tag, then the configuration of the EAS tag 205 may not permit the EAS tag 205 to be deactivated.

In example embodiments where the EAS tag 205 is deactivatable, the EAS tag 205 may also be configured to deactivate in response to being disposed within a deactivation field. In this regard, the deactivation field (e.g., deactivation field 211) may be generated by a deactivator (e.g., deactivator 210) at, for example, a point of sale (POS) within a retail establishment during a purchasing event of a product to which the security device 200 is attached. To deactivate the EAS tag 205 embodied as a deactivatable RF EAS tag, the EAS tag 205 may be affected by the deactivation field such that a current within the tag exceeds a threshold where insulation between two capacitive plates of the tag break down destroying the tag's ability to provide a response signal when exposed to a gate field. In example embodiments where the EAS tag 205 is a deactivatable AM EAS tag, the deactivation field may change the magnetism of ferrous strips within the tag, thereby changing the resonant characteristics of the tag and preventing further operation in response to a gate field. As such, when deactivated, the EAS tag 205 may be configured to no longer provide the wireless response signal in response to a being disposed within a gate field.

Regardless of whether the EAS tag 205 is deactivatable or non-deactivatable, the tamper detection circuitry 202 may also be disposed within the housing 201 with the EAS tag 205. The tamper detection circuitry 202 may comprise a number of electronic components connected and configured to perform the operations and functionalities of the tamper detection circuitry 202 as described herein. To power the tamper detection circuitry 202, the tamper detection circuitry 202 may include a battery 260. According to some example embodiments, the tamper detection circuitry 202 may include alarm control circuitry 210. The alarm control circuitry 210 may be a control center of the tamper detection circuitry 202 and may include components such as a processing device or transistors (e.g., metal oxide semiconductor field effect transistor (MOSFET)) connected and configured to control the activation and deactivation of the tamper detection circuitry 202 and tamper alarming. According to some example embodiments, the processing device (e.g., a processor, microprocessor, etc.) may be configured via execution of software commands to be a special-purpose device for performing the functionalities described herein. In this regard, the alarm control circuitry 210 may also include a memory where such software commands are stored for execution by the processing device. Alternatively, the processing device may be configured in hardware as an application specific integrated circuit (ASIC) or a field programmable gate array (FPGA) to be a special-purpose device for performing the functionalities described herein. Further, the alarm control circuitry 210 may be implemented, according to some example embodiments, without a processing device using circuit design configured to generate the logic described herein. In general, the alarm control circuitry 210 may be configured to receive signals from sensors in the form of inputs to generate controlled outputs (e.g., triggering a sounder). In this regard, for example, the alarm control circuitry 210 may be configured to control the tamper detection circuitry 202 to implement a sense loop alarm function and activate or deactivate the sense loop alarm function as described herein.

The tamper detection circuitry 202 may also comprise a tamper sensor 220, a sounder 240, a light 250, and a deactivation sensor 270. According to some example embodiments, the tamper sensor 220 may be configured to detect, for example, a discontinuity in a conductive strip 230 (e.g., due to a tamper event, which may be a severing of the conductive strip 230). In this regard, the tamper sensor 220 may comprise a pair of electrical contacts that permit the conductive strip 230 to be connected as a sense loop to the tamper sensor 220 (e.g., while being wrapped around product packaging). The conductive strip 230 may be the same or similar to the conductive strip 105 described above.

The tamper sensor 220 may be configured to detect a tamper event and generate a tamper signal in response to the tamper event. In this regard, detection of the tamper event may be detection of the loss of electrical continuity in the conductive strip 230 due to a severing of a conductive strip 230 that is electrically connected to the tamper sensor 230 to form a loop. As such, the tamper signal may be generated as, for example, a loss of current flow through and output from the conductive strip 230. For example, in an example embodiment where the conductive strip 230 is connected to ground on one end of the conductive strip 230 (e.g., via a contact of the tamper sensor 220), the voltage at the other end (i.e., the sensor end) of the conductive strip 230 may be used as a tamper signal. When the conductive strip 230 is not severed current will flow through the conductive strip 230 to ground and the voltage at the sensor end will be low. However, if a tamper event occurs and, for example the conductive strip 230 is cut, the voltage at the sensor end will increase to a high voltage (since the connection to ground has been lost and no current flows through the conductive strip 230). In this example embodiment, the presence of a high voltage at the sensor end may be the tamper signal.

It is understood that the tamper sensor 220 may be any type of tamper sensor for detecting attempts to remove the security device 200 from a product. As such, the tamper sensor 220 coupled to the conductive strip 230 to detect the occurrence of a tamper event in the form of a severing of the conductive strip 230 is one example tamper sensor 200 implementation. Other implementations of tamper sensor 220 are therefore also contemplated, such as, for example, tamper sensors that comprise a plunger switch that mechanically actuates in response to removal of the security device 200 from product packaging and changes state (e.g., closed to open) to generate the tamper signal.

The tamper detection circuitry 202 also includes a deactivation sensor 270. In general, according to some example embodiments, the deactivation sensor 270 may include a device that may changes between a high resistance and a low resistance when the sensor detects the presence of a deactivation field. In this regard, the deactivation field that the deactivation sensor 270 is configured to detect may be the same deactivation field (e.g., have the same required characteristics, such as frequency and power) that operates to attempt to deactivate the EAS tag 205. As such, a single field generated by a deactivator (e.g., deactivator 210) may operate to both deactivate a deactivatable EAS tag 205 and be detected by the deactivation sensor 270. Additionally, the single deactivation field may be triggered by the presence of the EAS tag 205, for detection by the deactivation sensor 270 of the tamper detection circuitry. Further, as mentioned above, the presence of the EAS tag 205 may cause a deactivator to increase the power and generate the deactivation field in response to a response signal provided by the EAS tag 205 to permit the deactivation sensor 270 to detect the deactivation field. Further, the deactivation sensor 270 may be configured to generate a deactivation signal within the tamper detection circuitry 202 in response to detecting the deactivation field. The deactivation signal may, according to some example embodiments, be a change in voltage due to an open or close switch operation or operation of a transistor (e.g., MOSFET) or similar device to permit or prevent current flow.

According to some example embodiments, the deactivation sensor 270 may include a switch (e.g., in the form of a magnetically operated reed switch, a semiconductor switching device implemented as a transistor (e.g., MOSFET), or the like). As further described below with respect to FIGS. 6 to 8B, example embodiments of a reed switch implementation of the deactivation sensor 270 are provided.

Alternatively, according to some example embodiments, other implementations of a deactivation sensor 270 may be employed. For example, an antenna (e.g., an inductor) or a resonant circuit may be utilized in some example embodiments. Alternatively, a thin-film device may be utilized as the deactivation sensor 270. In this regard, for example, a tunnel-magnetoresistance (TMR) sensor may be used. A TMR may be implemented as a thin-film technology that utilizes a magnetoresistive effect that can occur in a magnetic tunnel junction of the device to detect a deactivation field. In this regard, the TMR may comprise two ferromagnetic films separated by an insulator (e.g., a thin insulator on the order of a few nanometers) that permits electrons to tunnel from one ferromagnetic film to the other based on quantum mechanics. Electrical junctions may be disposed on each ferromagnetic film. Accordingly, a direction of the magnetizations of the ferromagnetic films may be switched individually by an external magnetic or electromagnetic field (e.g., the deactivation field) which can cause the TMR to transition between high electrical resistance state between the junctions and the low resistance state between the junctions. As such, the TMR may be configured to operate similar to a switch that is controllable by the deactivation field and may be implemented within the tamper detection circuitry 202 as the deactivation sensor 270.

Further, the tamper detection circuitry 202 may also include a sounder 240 and a light 250. The sounder 240 may be any type of audio device capable of being controlled to selectively emit an audible sound. In this regard, the sounder 240 may be the same or similar to sounder 163 and may comprise piezo buzzer, speaker, or the like. According to some example embodiments, the sounder 240 may include a transformer to facilitate generation of louder audible sound. As described herein, the sounder 240 may be triggered to emit sound in response to a tamper event (e.g., severing of the conductive strip 230) to alert store personnel of a possible theft event. In this regard, the sounder 240 may be configured to emit an audible sound in response to a tamper signal, when the tamper detection circuitry 202 is active as further described herein.

The light 250 may be a device such as, for example, a light emitting diode (LED) or the like, that can be controlled to selectively emit light. In this regard, the light 250 may be configured, as further described herein, to emit light in response to a tamper signal. Additionally or alternatively, the light 250 may be configured to emit light in response to the tamper detection circuitry 202 being in an active state and not emit light in response to the tamper detection circuitry 202 being in an deactivated state. As such, the tamper detection circuitry 202 may be configured to illuminate the light 250 in response to the tamper detection circuitry 202 being in the active state, and not illuminate the light 250 in response to the tamper detection circuitry 202 being in the deactivated state.

With respect to the operation of the tamper detection circuitry 202, the tamper detection circuitry 202 may be in an active or deactivated state. In the active state, the tamper detection circuitry 202 is "armed" and will cause, for example, the sounder 240 to output an audible sound in response to receipt of a tamper signal from the tamper sensor 220 due to a tamper event. Alternatively, in the deactivated state, the tamper detection circuitry 202 is "disarmed" or deactivated and does not respond to a tamper event, and therefore, for example, the sounder 240 is not caused to emit an audible sound when a tamper event occurs (e.g., the conductive strip 230 is severed). As such, the tamper detection circuitry 202 may be in the active state when the security device 200 is affixed to a product in a store waiting to be purchased. Further, the conductive strip 230, implemented as a sense loop, is operating to protect the product from theft in the active state. In the deactivated state, the product with the security device 200 attached has been purchased and exposed to the deactivation field, and the tamper detection circuitry 202 is disarmed to permit a customer to bring the product home and remove the security device 200 (i.e., sever the conductive strip 230) without, for example, the sounder 240 emitting an audible sound.

Accordingly, the tamper detection circuitry 202 may be configured to trigger the sounder 240 to emit an audible sound in the form of an alarm sound in response to receiving the tamper signal from the tamper sensor 220 when the tamper detection circuitry 202 is in the active state. Further, according to some example embodiments, the tamper detection circuitry 202 may also be configured to transition the tamper detection circuitry 202 to the deactivated state in response to receiving the deactivation signal from the deactivation sensor. As mentioned above, in the deactivated state, receipt of the tamper signal does not trigger the sounder to emit the alarm. According to some example embodiments, the state of the tamper detection circuitry 202 (i.e., active or deactivated state) may be based on the state of the deactivation sensor 270. For example, in an implementation where the deactivation sensor 270 is a TMR, the tamper detection circuitry 202 may be in the active state when the TMR has a low resistance between the junctions and in a deactivated state when the TMR has a high resistance between the junctions.

As mentioned above, the EAS tag 205 and the deactivation sensor 270 may detect and take action in response to the same deactivation field. As such, according to some example embodiments, the EAS tag 205 may be configured to respond to a sense field of a deactivator to trigger a deactivation field. If the EAS tag 205 is a deactivatable EAS tag, the EAS tag 205 may deactivate in response to being disposed within and detecting the deactivation field. Additionally, the deactivation sensor 270 may be configured to generate a deactivation signal in response to the deactivation field. Further, the deactivation field may be required to have at least a threshold power to deactivate a deactivatable EAS tag 205, and, the deactivation sensor 270 may also provide the deactivation signal in response to detecting the deactivation field having at least the threshold power. Further, the EAS tag 205 and the deactivation sensor 270 may be tuned to a frequency of the deactivation field, and the EAS tag 205 may be tuned to the same frequency. According to some example embodiments, the deactivation field and the gate field (described above) that are detected by the EAS tag 205 and the deactivation sensor 270 may operate to generate a field at the same frequency. Example frequencies for the deactivation field and the gate field may include 8.2 MHZ, 4.8 MHz, or 58 kHz. Further, although the gate field and the deactivation field may be the same frequency, the gate field may provide a field power that is not high enough to cause the deactivation sensor 270 to generate the deactivation signal. As such, the gate field is insufficient to deactivate the tamper detection circuitry 202.

Figure 5:
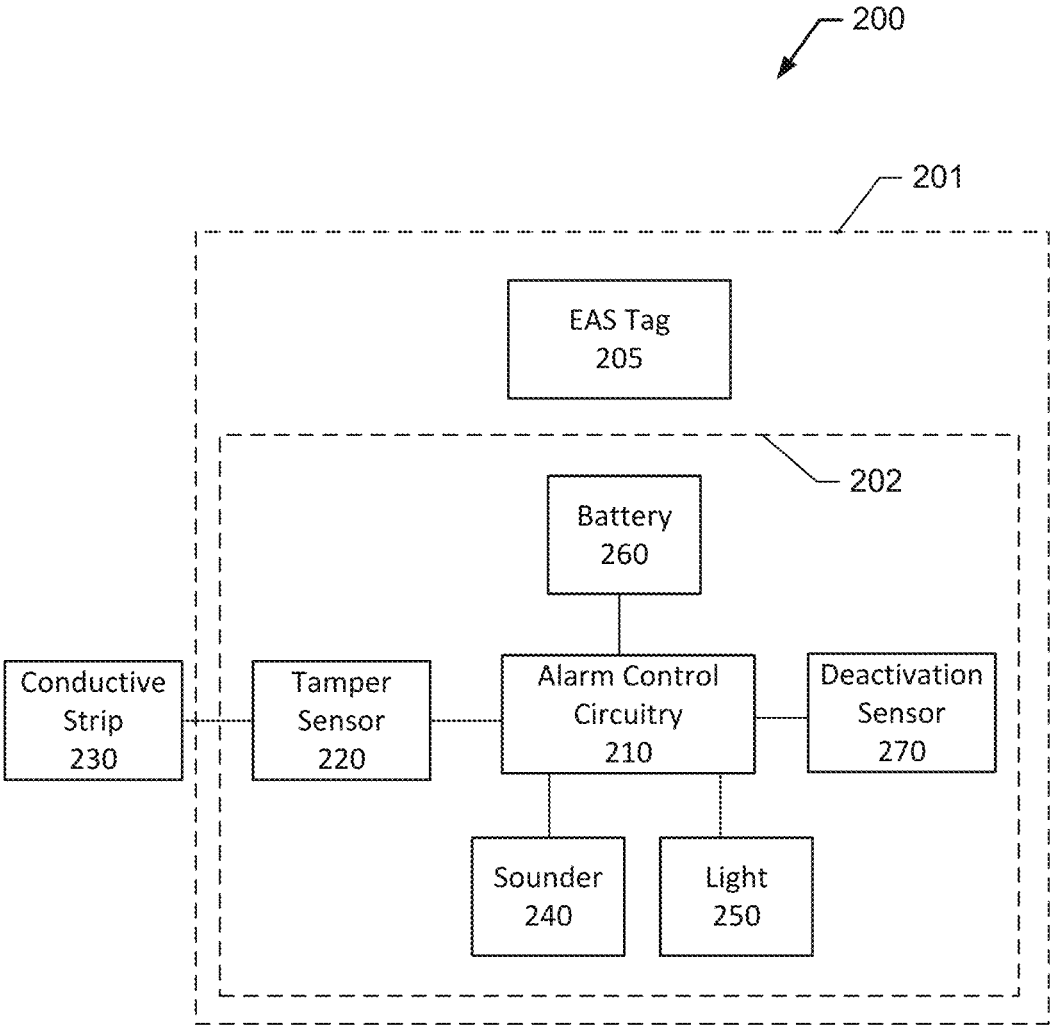
FIG. 5 illustrates a block diagram of components of a security device according to some example embodiments.
Figure 6:
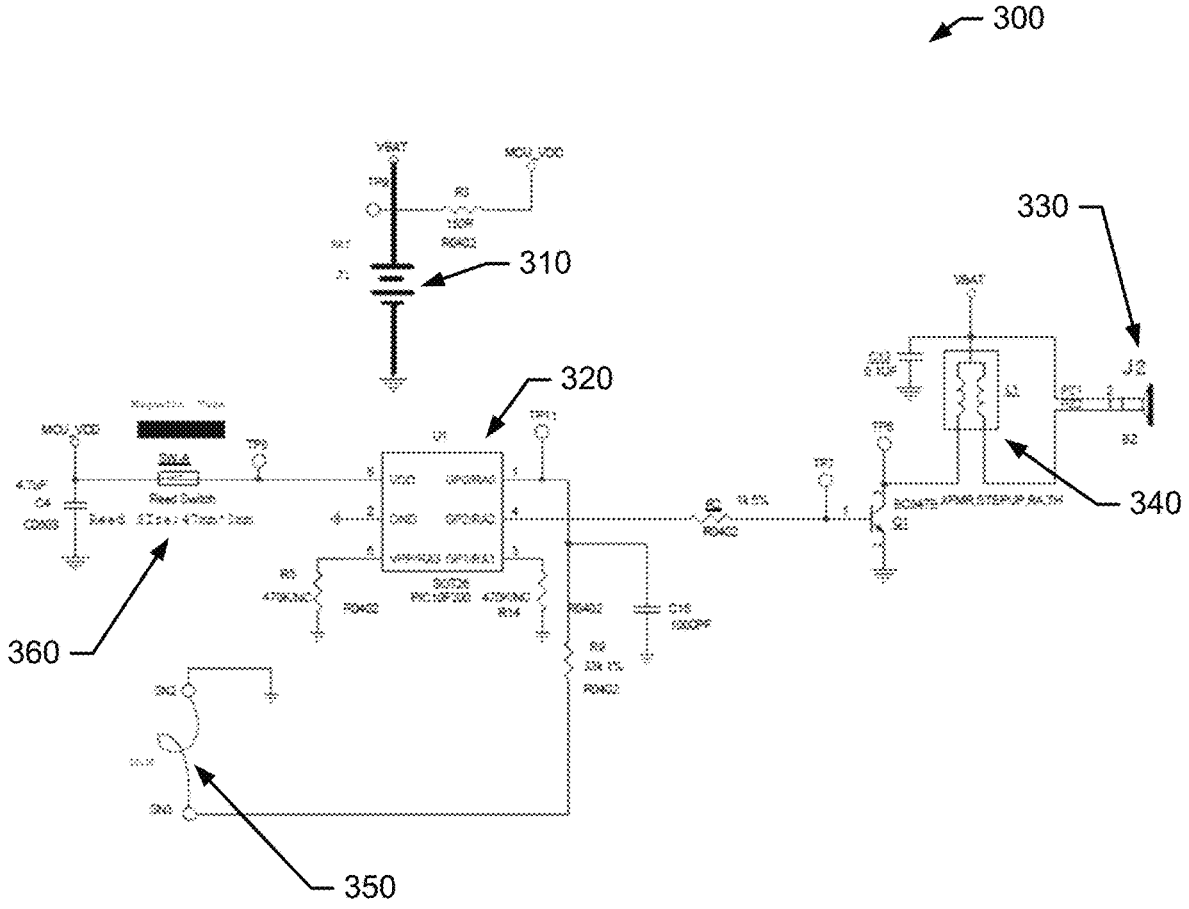
FIG. 6 illustrates an example circuit diagram for tamper detection circuitry of a security device according to some example embodiments.

In view of the block diagram of FIG. 5, FIG. 6 illustrates an example circuit diagram for tamper detection circuitry 300 of a security device (e.g., security device 200) according to some example embodiments. In this regard, the tamper detection circuitry 300 may include a battery 310 (e.g., battery 260), integrated processing circuit chip 320 (e.g., alarm control circuitry 210), sounder 330 (e.g., sounder 240), sounder transformer 340, conductive strip 350 (e.g., conductive strip 230), and a deactivation sensor in the form of deactivation switch 360 (e.g., deactivation sensor 270). In operation, the chip 320 may be configured to monitor the connectivity of the conductive strip 350 and monitor the switch state (e.g., open or closed) of the deactivation switch 360. If the conductive strip 350 is severed while the deactivation switch 360 is activated (e.g., closed), then the chip 320 may be configured to cause the sounder 330 to emit an audible alarm with the assistance of the sounder transformer 340. If, however, the conductive strip 350 is severed while the deactivation switch 360 is deactivated (e.g., open), then the chip 320 may be configured to maintain the sounder 330 in silence and not trigger the sense loop alarm.

Figure 7A:
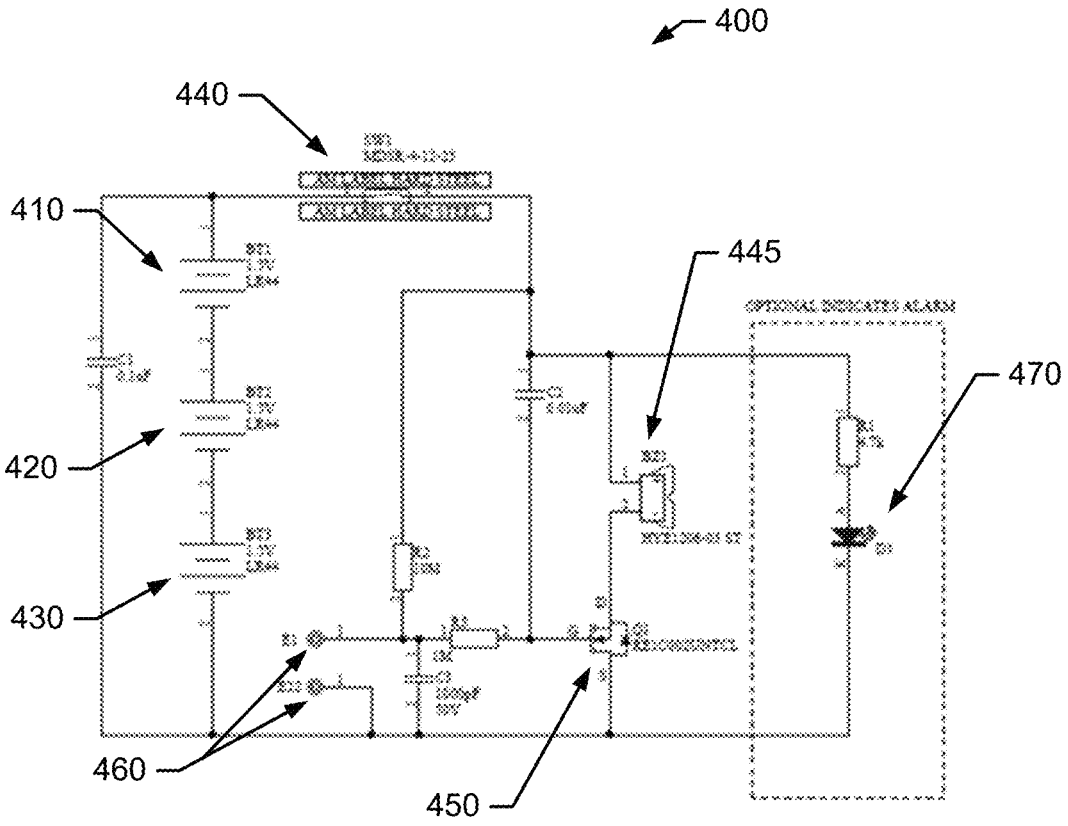
FIG. 7A illustrates another example circuit diagram for tamper detection circuitry of a security device according to some example embodiments.

FIG. 7A illustrates another example circuit diagram for tamper detection circuitry 400 for a security device (e.g., security device 200) according to some example embodiments. In this regard, the tamper detection circuitry 400 does not include an integrated circuit to perform the functionalities described herein, rather, a circuit leveraging the operation of a transistor 450 is used. According to some example embodiments, the transistor 450 may be a MOSFET. The tamper detection circuitry 400 may include batteries 410, 420, and 430 (e.g., battery 260), a deactivation sensor in the form of deactivation switch 440 (e.g., deactivation sensor 270), a sounder 445 (e.g., sounder 240), transistor 450 (alarm control circuitry 210), conductive strip contacts 460 (e.g., conductive strip contacts of tamper sensor 220), and a light 470 (e.g., light 250). In this regard, due to the operation of the transistor 450 within this context, the functionalities of the security device 200, as described herein, may be performed. The transistor 450 may be configured to control current to the sounder 445 based on the connectivity of a conductive strip connected between the conductive strip contacts 460. In this regard, the tamper detection circuitry 400, via the transistor 450, may be configured to monitor the connectivity of the conductive strip connected to conductive strip contacts 460 and monitor the switch state (e.g., open or closed) of the deactivation switch 440.

With respect to the operation of the tamper detection circuitry 400, while the deactivation switch 440 is activated (e.g., closed), if the conductive strip connected to the contacts 460 is severed, then the sounder 445 may emit an audible alarm because the gate terminal of the transistor 450 will be electrically biased to permit current to flow through the sounder 445 from the batteries 410, 420, and 430 to ground (e.g., the negative terminal of battery 430). If, however, the conductive strip connected to the contacts 460 is severed while the deactivation switch 440 is deactivated (e.g., open), then the sounder 445 may remain silent and the sense loop alarm will not be sounded because, with the deactivation switch in the open position, no current can flow from the batteries 410, 420, and 430 to the sounder 445, regardless of the biasing on the gate terminal of the transistor 450. The light indicator 470 may be configured to emit light, for example, when the deactivation switch is closed indicating that the tamper detection circuitry 400 is in the active state and ready to be armed by connecting a conductive strip to the contacts 460.

Figure 7B:
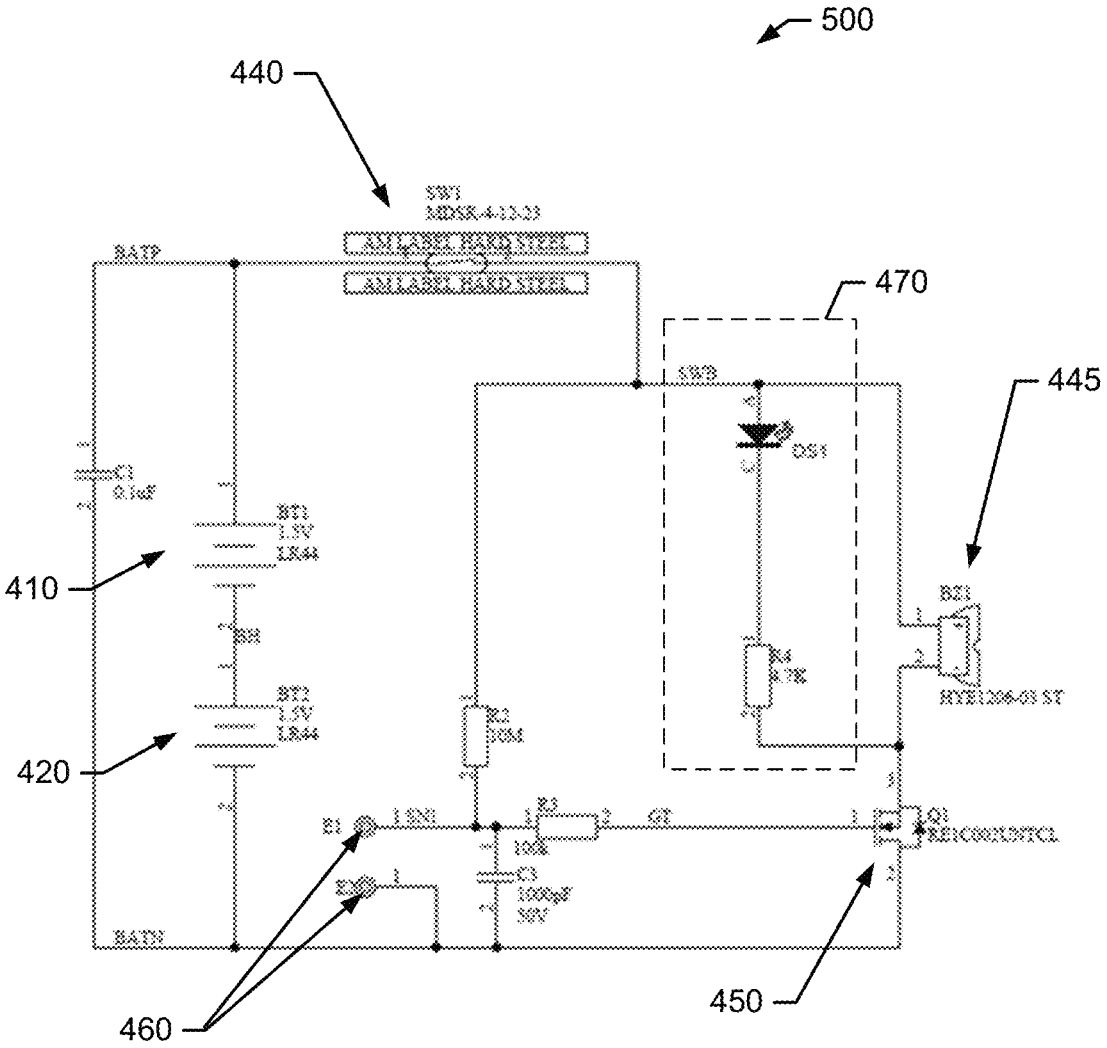
FIG. 7B illustrates another example circuit diagram for tamper detection circuitry of a security device according to some example embodiments.

FIG. 7B illustrates another example circuit diagram of another tamper detection circuitry 500 according to some example embodiments. In this regard, the tamper detection circuitry 500 includes many of the same components as the tamper detection circuitry 400, however, in a slightly different electrical configuration. Again, the tamper detection circuitry 500 may be configured to monitor the connectivity of the conductive strip connected to contacts 460 and monitor the switch state (e.g., open or closed) of the deactivation switch 440. If the conductive strip connected to the contact 460 is severed while the deactivation switch 440 is activated, then the sounder 445 may emit an audible alarm. If, however, the conductive strip connected to the contacts 460 is severed while the deactivation switch 440 is deactivated, then the sounder 445 may remain silent and the sense loop alarm will not be sounded. However, in the example embodiment of FIG. 7B, the light indicator 470 may be configured to emit light when the sense loop alarm is activated and the sounder 445 is emitting audible sound. The light indicator 470 may be configured to emit light when the sounder 445 emits sound.

Figure 8A:
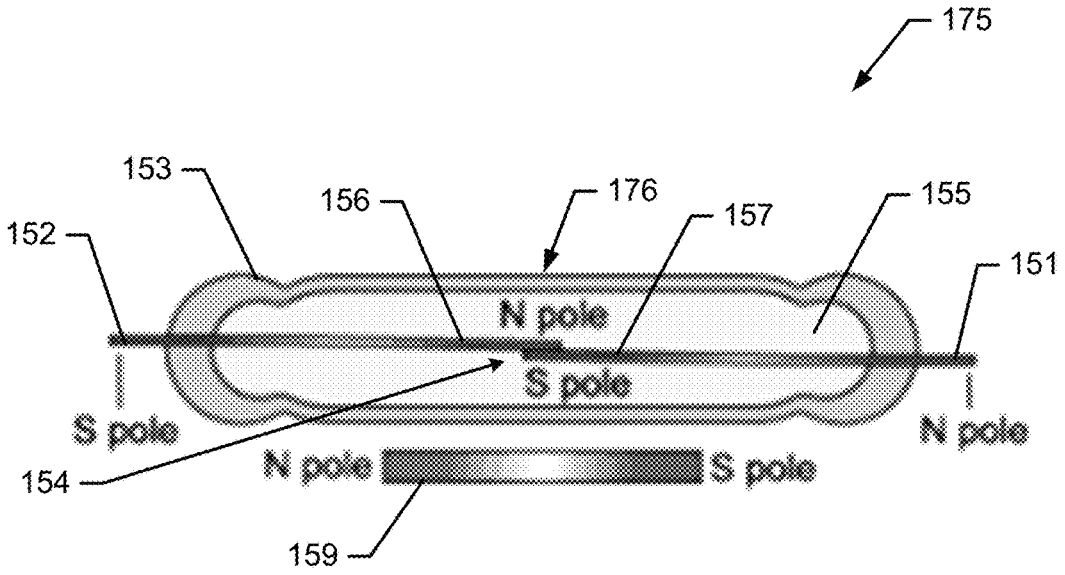
FIG. 8A illustrates an example reed switch of a deactivation sensor in a closed state according to some example embodiments.

FIG. 8A illustrates the example deactivation sensor 175, which may operate as described with respect to deactivation sensor 270. The deactivation sensor 175 may comprise a reed switch 176 and at least one magnetizable strip 159 in close proximity to the reed switch 176. As shown in FIG. 8A, the reed switch 176 is closed as indicated by the physical contact at 154 between the reed blades 156 and 157. The reed switch 176 may include a capsule 153 (e.g., a glass capsule), an inert gas 155, reed blades 156 and 157, switch terminals 151 and 152, and at least one magnetizable strip 159. In the closed state, as shown in FIG. 8A, the tamper detection circuitry 200 would be in an active state and can be armed via connection of a conductive strip. In this regard, the magnetizable strip 159 has been magnetized and thus may generate a magnetic field that causes the reed blades 156 and 157 to deflect into a closed position where the reed blades 156 and 157 are in contact with each other, thereby permitting electric current to flow between terminal 151 and terminal 152. Magnetic strip 159 may be formed of magnetic iron, steel, or another ferrous material capable of being magnetized. A strong magnet may be used to magnetize the magnetic strip 159, for example, at manufacturing or after a use cycle if the security device 100 is being used as a reusable security device.

Figure 8B:
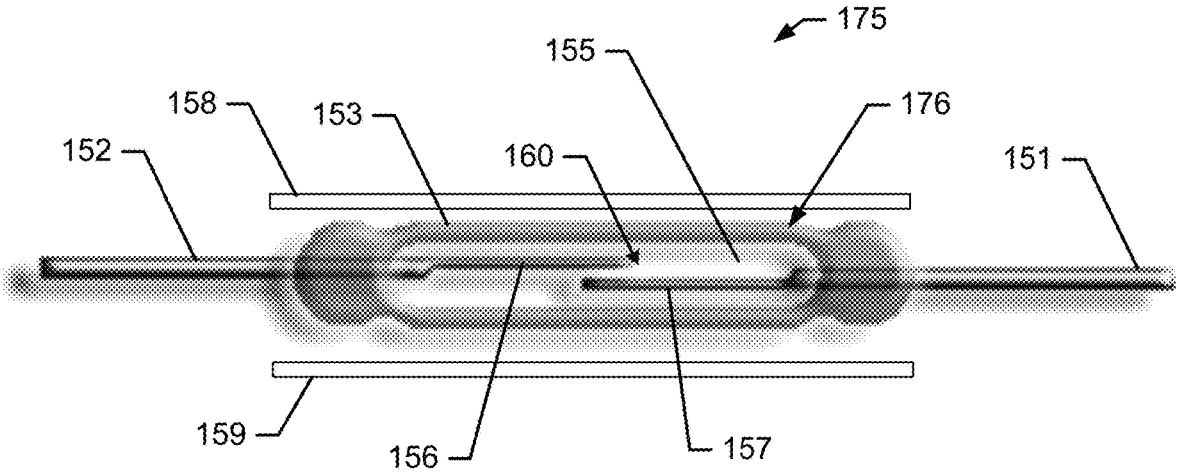
FIG. 8B illustrates an example reed switch of a deactivation sensor in an open state according to some example embodiments.

FIG. 8B also illustrates another example embodiment of the example deactivation sensor 175 and the reed switch 176. The magnetizable strips 158 and 159 may be demagnetized in response to receiving a deactivator field as described above. Magnetizable strip 158 may be same or similar to magnetizable strip 159 as described herein. Due to being demagnetized, magnetizable strips 158 and 159 may no longer provide a field to maintain the reed blades 156 and 157 in the closed positions, and the reed blades 156 and 157 may deflect into an open position and separate to form a gap 160 opening the reed switch 176 and deactivating the tamper detection circuitry 200. In this regard, the magnetizable strips 158 and 159 have been demagnetized and therefore no field is generated by the magnetizable strips 158 and 159 to deflect the reed blades 156 and 157 out of the open position and into the closed position. As such, with the deactivation switch 175 in the open position, terminal 151 is not connected to terminal 152 and no electric current may flow between the terminal 151 and terminal 152.

As such, the deactivation sensor 175 may be configured within the tamper detection circuitry (e.g., tamper detection circuitry 202) to perform the functionalities as described with respect to deactivation sensor 270. In this regard, the deactivation sensor 175 may include one or more magnetizable strips 158 and 159 disposed adjacent the reed switch 176. The one or more magnetizable strips 158 and 159, when magnified, may be configured to generate a field that maintains the reed switch 176 in a closed position which maintains the tamper detection circuitry in the active state. Further, in response to being disposed within the deactivation field, the one or more magnetizable strips 158 and 159 may be demagnetized such that the reed switch 176 opens, transitioning the tamper detection circuitry (e.g., tamper detection circuitry 202) to the deactivated state.

Now referring to FIGS. 9A to 9F, according to some example embodiments, a system 900 or components thereof are provided that comprises product packaging 910 (e.g., a box), and a product 914 within the product packaging 910 in the internal cavity 912. With respect to the side cross-section view of FIG. 9A, the system 900 may also comprise a security device 901 having an alarming unit 930 affixed to an interior surface of the product packaging 910 in electrical connection with a conductive strip 940 that is disposed on the exterior of the product packaging 910. As such, an interior packaging installation of an alarming unit 930 is shown. In this configuration, the security device 930 may be applied with the alarming unit 930 within the product packaging 910 "at-source" when the product 914 is also placed into the product packaging 910.

Figure 9A:
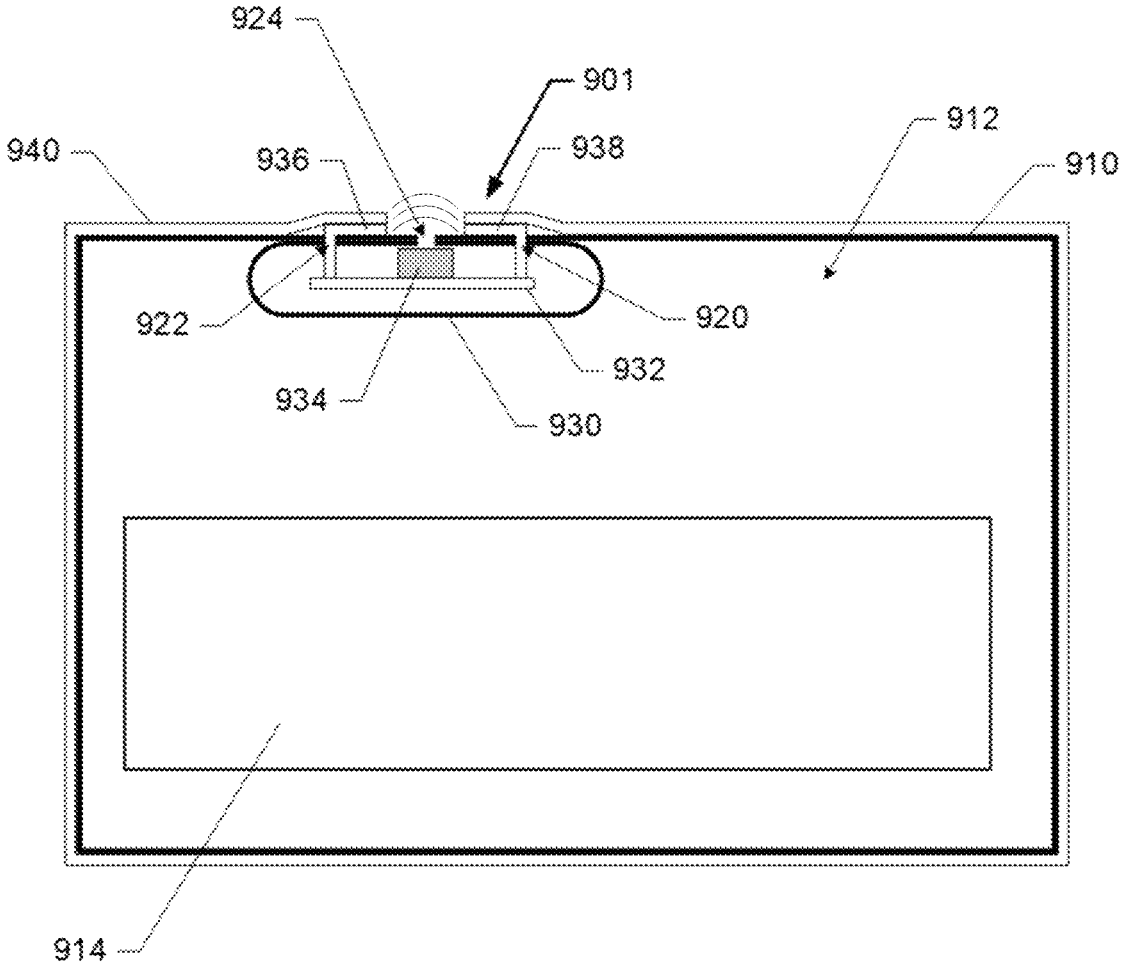
FIG. 9A is a cross-section view of a security device with an internally affixed alarming unit according to some example embodiments.

In this regard, the security device 901, which may be the same or similar to the security device 200, may include a main housing 930 with electronics disposed therein, and a conductive strip 940 that is configured to be wrapped around the product packaging 910, and, in particular, over seams or openable flaps of the product packaging 910. The alarming unit 930 may comprise an electronics board 932 which may be populated with various components including those described with respect to the security device 200. In FIG. 9A, the electronics board 932 is shown with tamper sensor contacts 936 and 938. Also, a sounder 934 is shown.

To affix the alarming unit 930 to the interior of the product packaging 910 an adhesive may be applied between the internal surface of the product packaging 910 and the alarming unit 930. Further to extend the tamper sensor contacts 936 and 938 to the exterior of the product packaging 910, openings 920 and 922 may be made in the product packaging 910. In this regard, for example, the tamper sensor contacts 936 and 938 may be formed as flexible conductive tabs that extend from the alarming unit 930 through the respective openings 920 and 922 and folded over onto the exterior of the product packaging 910 to form the contacts 936 and 938 for connection with a later-applied conductive strip 940 to form a sense loop as described herein. Additionally, an opening 924 may be made in the product packaging 910 that is adjacent to or aligned with the sounder 934 to facilitate emitting audible sound from the sounder 934 without being muffled by the surface of the product packaging 910.

Figure 9B:
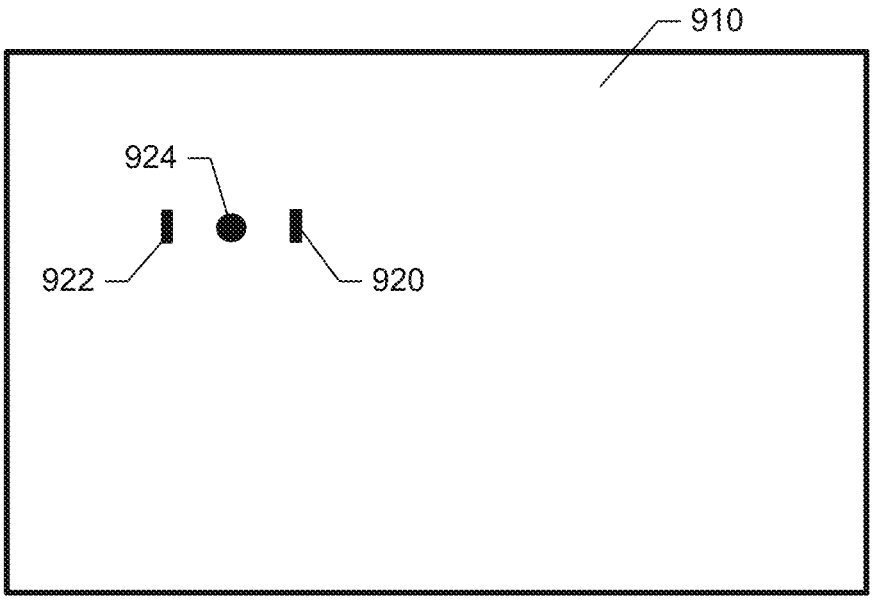
FIG. 9B is a top view of a product packaging box with openings to facilitate attachment of an internally affixed alarming unit according to some example embodiments.
Figure 9C:
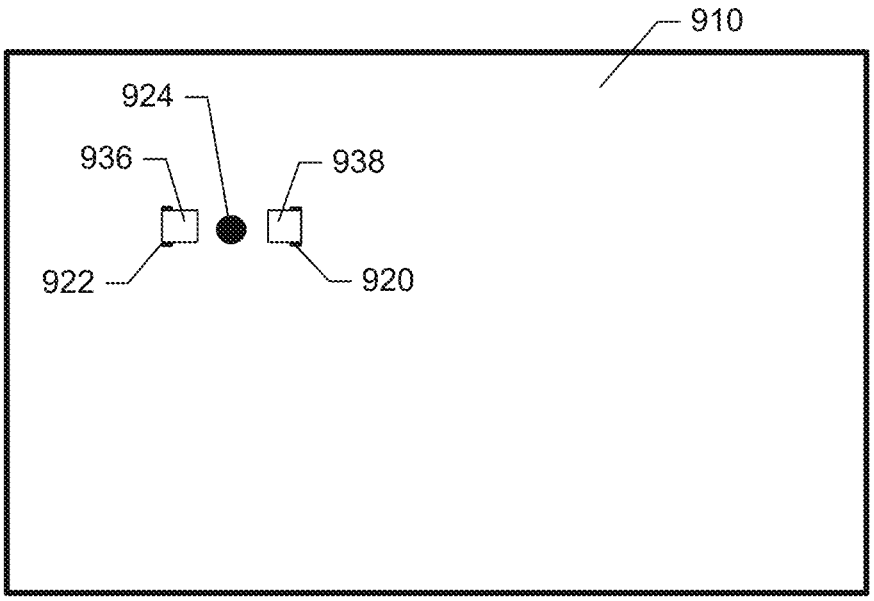
FIG. 9C is a top view of a product packaging box with conductive tabs of an internally affixed alarming unit passing through openings in product packaging according to some example embodiments.

In this regard, FIG. 9B shows a top view of the product packaging 910 prior to application of the alarming unit 930 within the product packaging 910. As shown, the opening 920 and 922 are spaced apart to facilitate receipt of the flexible tab contacts 936 and 938. Further, opening 924 is shown that can be adjacent or aligned with the sounder 934.

Following from FIG. 9A, FIG. 9B shows a top view of the product packaging 910 with the alarming unit 930 now installed within the product packaging 910. As shown, tamper sensor contacts 936 and 938 have been inserted into the respective openings 920 and 922. Further, as flexible tabs, the tamper sensor contacts 936 and 938 have been folded onto external surface of the product packaging 910 to increase the surface area for electrical connection with a conductive strip 940.

Figure 9D:
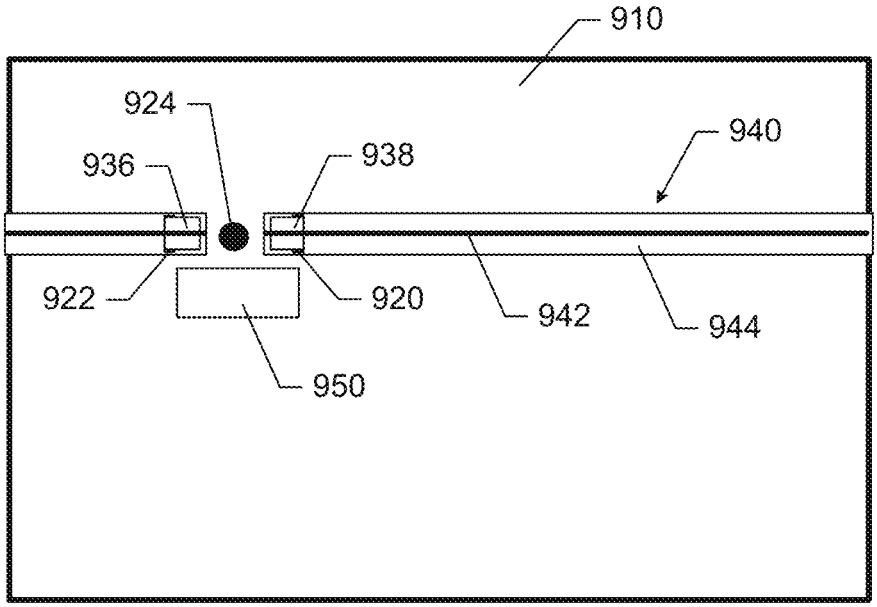
FIG. 9D is a top view of a product packaging box with a conductive strip connected to an internally affixed alarming unit according to some example embodiments.

In this regard, FIG. 9D shows a top view of the product packaging 910 with the alarming unit 930 installed internal to the product packaging 910 and a conductive strip 940 applied on an external surface or face of the product packaging 910. As shown, the conductive strip 940 overlays the tamper sensor contacts 936 and 938 and is therefore electrically connected to the tamper sensor contacts 936 and 938. The conductive strip 940 comprises a backing 944 with adhesive disposed on the underside of the backing 944. The adhesive facilitates attachment of the conductive strip 940 to the external surface of the product packaging 910. Additionally, the adhesive may affix a conductor 942 to the backing, where the conductor 942 runs along a length of the conductive strip 940. The conductor 942 is therefore exposed for electrical connection with a contact 938 or 936 on one side of the conductive strip 940, but is insulated from making an electrical connection on the other side of the conductive strip 940 due to the backing 944. As such, while FIG. 9D shows the conductive strip 940 as extending only from the contact 938 to the contact 936, if the conductive strip 940 extended past the contact 936 to overlap contact 938 again, no additional connection to contact 938 would be made.

Additionally, FIG. 9D also shows a placement for a product identifying feature at 950. In this regard, the product identifying feature may be a bar code or QR code. According to some example embodiments, the product identifying feature may be an RFID tag. Regardless of the type of product identifying feature, the alarming unit 930 may be disposed near or adjacent the product identifying feature at 950. Having the alarming unit 930 placed near the product identifying feature may be beneficial because, in some instances, the product identification scanners (e.g., barcode or QR code scanners, RFID readers, etc.) may also include components to generate a deactivation field. As such, by being located near the product identifying feature, the alarming unit 930 is likely to be placed within the deactivation field when the product identifying feature is being scanned or read during a purchasing event.

Figure 9E:
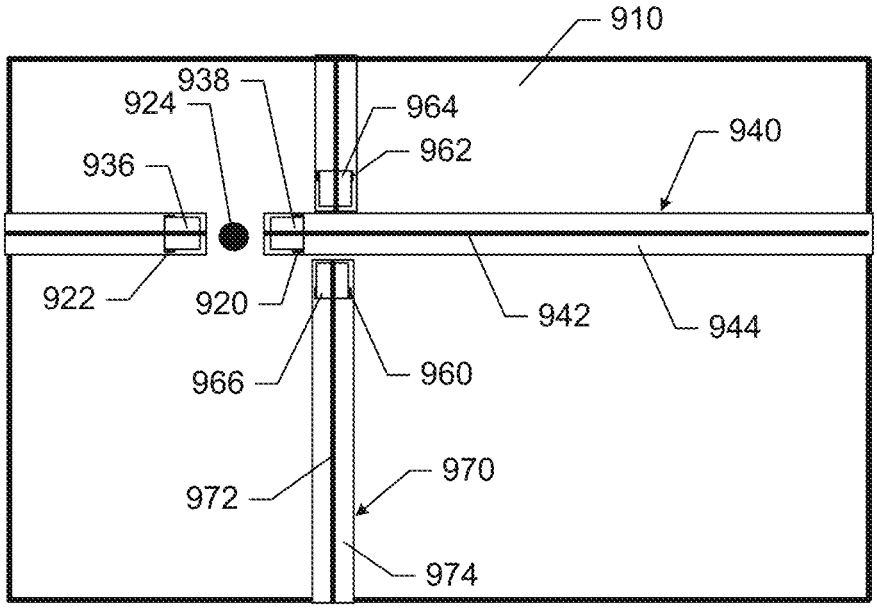
FIG. 9E is a top view of a product packaging box with two conductive strips connected to an internally affixed alarming unit according to some example embodiments.

FIG. 9E shows another example embodiment where the alarming unit 930 includes circuitry to detect tampering of two different conductive strips 940 and 970. The conductive strip 970 may be constructed in the same fashion as the conductive strip 940 described above. The tamper detection circuitry of the security device of FIG. 9E may cause a tamper signal to be generated when the tamper detection circuitry is active and either of the conductive strips 940 or 970 are severed. In this regard, the product packaging 910 may include two additional openings 960 and 962 through which contacts 964 and 966 pass and are folded over to increase the surface area for electrical connection. The conductive strip 970, comprising the backing 974 and conductor 972, may be wrapped around the product packaging 910, such that, for example the edges of the two surfaces and associated edges of the product packaging 910 that were not engaged by the conductive strip 940 are engaged by the conductive strip 970. As such, in this configuration, all edges of the product packaging 910, as a box, are therefore protected by the conductive strips 940 and 970.

Figure 9F:
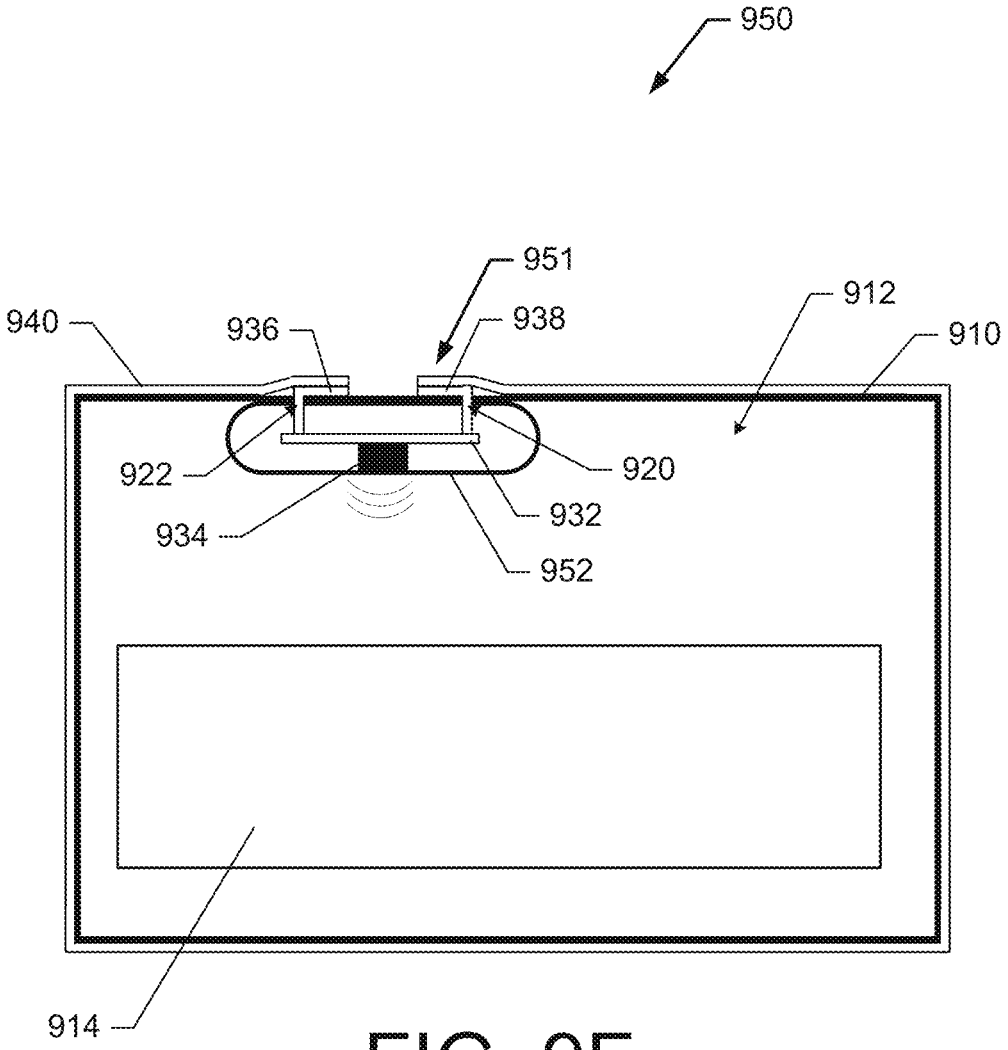
FIG. 9F is a cross-section view of a security device with an internally affixed alarming unit where the sounder is directed internally according to some example embodiments.

Now referring to FIG. 9F, another example embodiment as system 950 where the sounder 934 directed into the internal cavity of the product packaging 910. In this regard, the security device 951 and the associated alarming unit 952 may be similar to the security device 901 and the alarming unit 930, with the exception that the sounder 934 is directed to fire sound towards the interior of the product packaging 910. To do so, according to some example embodiments, the sounder 934 may be disposed on the electronics board 934 on an interior facing surface with the sound port of the sounder 934 directed internally. In this configuration, when a sound is emitted due to a tamper event, the sound volume will substantially increase when the thief opens the product packaging 910 and the emitted sound is permitted to escape from the product packaging 910 unmuffled. Since the sounder 934 does not fire sound towards the exterior of the product packaging 910, the opening 924 in the product packaging 910 may not be needed.

Figure 10:
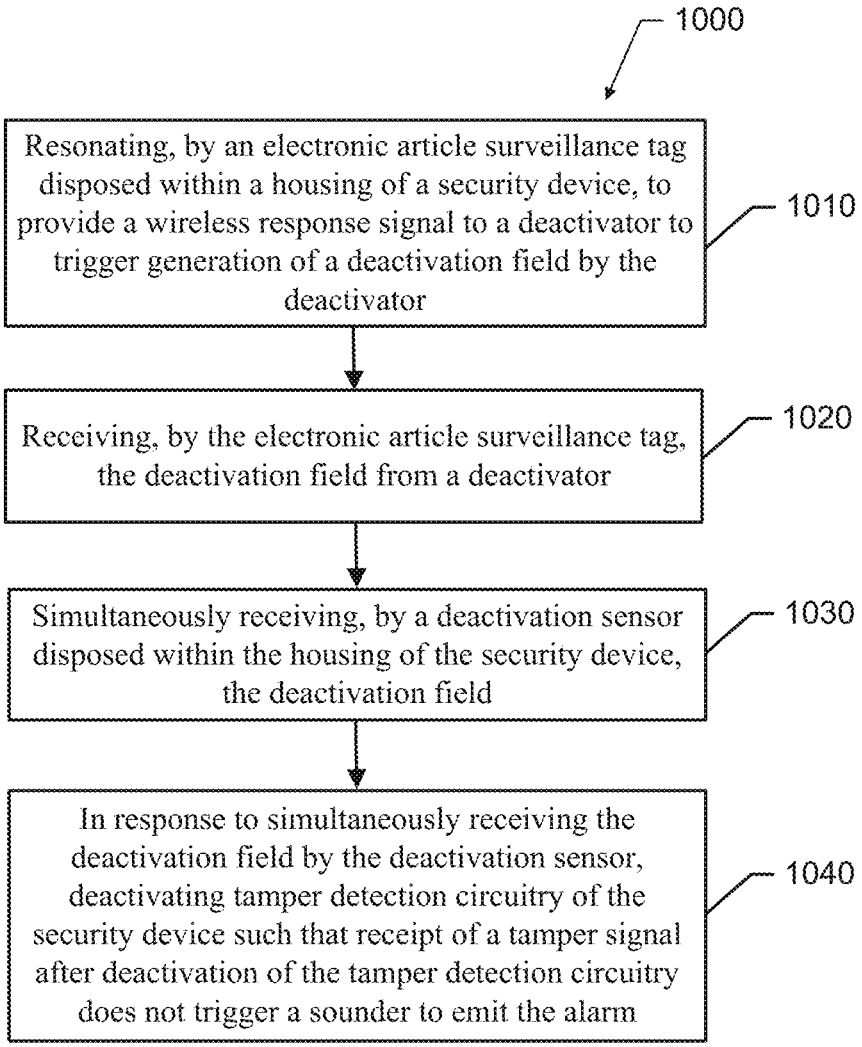
FIG. 10 is a flowchart of an example method for security device operation according to some example embodiments.

According to some example embodiments, an example method 1000 is provided in FIG. 10. The example method 1000 may comprise, at 1010, resonating, by an electronic article surveillance tag (e.g., EAS tag 205) disposed within a housing (e.g., housing 201) of a security device (e.g., security device 200), to provide a wireless response signal to a deactivator to trigger generation of a deactivation field (e.g., deactivation field 211) by the deactivator (e.g., deactivator 210). The example method 1000 may also include, at 1020, receiving, by the electronic article surveillance tag, the deactivation field from a deactivator. Further, the example method 1000 may also include, at 1030, simultaneously receiving, by a deactivation sensor disposed within the housing of the security device, the deactivation field. Additionally, at 1040, the example method 1000 may include, in response to simultaneously receiving the deactivation field by the deactivation sensor, deactivating tamper detection circuitry of the security device such that receipt of a tamper signal after deactivation of the tamper detection circuitry does not trigger a sounder to emit the alarm. Additionally, according to some example embodiments, the deactivation sensor may comprise a reed switch or a tunnel-magnetoresistance sensor. Additionally or alternatively, a frequency of the deactivation field is about 8.2 MHZ, 4.8 MHz, or 58 kHz.

As mentioned above, example embodiments of a security device as provided herein may be disposable or reusable. With respect to the aspects of deactivation, according to some example embodiments, a disposable security device may operate in the same manner as a reusable security device, with the exception that an EAS tag in the disposable security device may be deactivatable and the EAS tag in the reusable security device may be non-deactivatable. The following provides further description of additional example embodiments that may be implemented as either disposable or reusable security devices, according to some example embodiments.

Among other example embodiments, an example security device is provided herein that includes an alarming unit and a cleat for attaching the alarming unit to a product to protect. The alarming unit may include local alarming tamper detection features that may be disarmed at, for example, a point-of-sale (POS) via a deactivator and, if the security device is reusable, may be configured to subsequently re-arm the tamper detection features under certain conditions for reuse in the retail environment. Further, according to some example embodiments, the security device may comprise an alarming unit that includes a locking mechanism to removably secure the alarming unit to a product. As such, according to some example embodiments, to remove the alarming unit in an authorized fashion and avoid triggering a tamper alarm, the tamper detection features may be required to be deactivated or disarmed by detecting a deactivation field (for example, as described above) prior to unlocking the alarming unit from the product. If a deactivation field is not first detected, then removal of the alarming unit can result in a tamper event and an audible alarm in the form of a tamper alarm may be sounded. According to some example embodiments, the alarming unit may be designed such that no key is required for mechanical removal of the security device. In this regard, for example, the security device may include a push button or other mechanical feature that may allow a user to unlock and remove the alarming unit without a tool. In some example embodiments, an alarming unit may be required to interface with a key or other tool, such as a magnetic key, to facilitate removal of the alarming unit from, for example, a cleat or other member that facilitates attachment of the alarming unit to the product. However, if the security device does not first detect the deactivator field, then an alarm will sound when the security device is removed from the product.

In this regard, the security device (e.g., alarming unit and cleat) may be configured to be applied to a retail product to protect the retail product from theft. The security device may include tamper detection circuitry that is configured to cause a local alarm to be sounded when a tamper event is detected indicating that an unauthorized removal of the security device from the product or tampering of the security device is being attempted. According to some example embodiments, the tamper detection circuitry may include, for example, a tamper switch that may be positioned to actuate and trigger an audible tamper alarm if the security device is pulled away from the product to which the security device is affixed. Additionally or alternatively, according to some example embodiments, a security device may include a conductive loop with an electrical conductor that can be wrapped around or passed through an opening in the product to secure the security device to the product. In this regard, the conductive loop may be wrapped around a box-shaped item in a crossover fashion such that the continuous conductive loop wraps around each planar surface of the box-shaped item. According to some example embodiments, a crossover cleat may be used with a security device to facilitate both coupling the security device to the product and electrically connecting two conductive strips into a conductive loop that forms a continuous electrical path between two contacts on the security device. As such, the conductive loop which may be formed using one or more conductive strips as described below, which may be any type of conductor such as a wire or cable that may locked in connection with the alarming unit when installed on a product. If the conductive loop is opened, e.g., due to tampering that severs the electrical conductor of the conductive loop, the security device may detect the open state of the conductor and trigger an audible tamper alarm due to the detection of the tamper event. The audible tamper alarm may notify store personnel that a tamper event has occurred. As further described herein, a tamper event may occur if a key (e.g., magnetic key) is used to remove the security device from the product prior to the security device detecting a deactivator field.

In this regard, according to some example embodiments, the conductive loop may include adhesive that affixes the conductive loop to the item to, for example, prevent flaps of a box or packaging housing the product from being opened. Further, the conductive loop may be connected to the tamper detection circuitry of the example security device at both ends. As such, the example security device may be configured to monitor the connectivity of the conductive loop, and if the conductive loop is severed (e.g., due to the conductive loop being cut due to an attempt to open the product packaging or due to an attempt to otherwise separate the security device from the product), then an alarm, local to the security device, may be sounded to alert store personnel.

According to some example embodiments, the tamper detection circuitry of the security device may be deactivated to allow, for example, an authorized removal of the alarming unit from the product by store personnel or removal of the alarming unit by a customer after leaving the store with the purchased product. As described herein, to deactivate the tamper detection circuitry of the security device, the security device may be configured to detect an EAS deactivator and, more specifically, the electromagnetic fields generated by a deactivator. The deactivator may be a device that can be used to deactivate certain electronic article surveillance (EAS) tags (e.g., labels) by altering or destroying the resonant characteristics of the tags using the electromagnetic field of the deactivator so that the EAS tag no longer resonates when exposed to a field within a given frequency band. In this regard, as described herein, EAS tags may be of two types, i.e., deactivatable and non-deactivatable. Deactivatable EAS tags may configured such that when a deactivatable EAS tag is subjected to an electromagnetic field having select characteristics (i.e., at a certain frequency and at certain power levels), the EAS tag may be deactivated. On the other hand, a non-deactivatable EAS tag may not be deactivated, and will continue to resonate, even after being exposed to an electromagnetic field that is attempting to deactivate that EAS tag. Accordingly, as referred to herein, a generic reference to an "EAS tag" may be referring to either a deactivatable or non-deactivatable EAS tag, unless the context deems otherwise.

In this regard, a POS may include such a deactivator device that may be incorporated into, for example, a deactivator pad. Other types of deactivators may also be utilized such as ones that are integrated into a barcode scanning device or a deactivator wand. The deactivator may be configured to output an electromagnetic field at the resonant frequency of the EAS tag. In operation, the EAS deactivator may first undertake an interrogation process to determine that an EAS tag is within a deactivation zone (e.g., 2 or 3 inches) of the deactivator. The interrogation process may involve outputting an interrogation (or sense) field to excite the EAS tag to provide a detectable return signal from the EAS tag. The interrogation field may be of a sufficient power level to excite the EAS tag without deactivating the EAS tag. Upon detecting that an EAS tag is present in the deactivation zone, the EAS deactivator may output a deactivation field to deactivate the EAS tag. The deactivation field may have certain characteristics (e.g., frequency and power level) to deactivate a deactivatable EAS tag. In this regard, some EAS deactivators may use multiple field pulses. The frequency of the field generated by each pulse may be different such that the pulses scan across of a range of frequencies. Additionally, the rate at which the pulses are output (e.g., the pulse rate) may be defined for a deactivator and the deactivator may be identified by sensing the pulse rate. Further, according to some example embodiments, for AM systems, the deactivation field may be a degaussing field that has a high magnetic component that decays over time to reduce or eliminate the magnetism of the AM EAS tag. Thus, upon detecting the presence of the EAS tag within the deactivator field at the POS due to receipt of a return signal from the EAS tag, the deactivator may be configured to output a different field to deactivate the EAS tags, and the characteristics of the deactivation field may be detectable by a security device to differentiate between a field generated by an EAS deactivator and a field generated by an EAS gate. The deactivator field may operate to deactivate the EAS tag, for example, by increasing a current in a radio frequency (RF) resonant circuit of an RF EAS tag to breakdown the dielectric between the plates of a capacitor and cause a short between the plates thereby preventing further resonating of the EAS tag. Alternatively, the deactivator field may operate to change the magnetism in a metal strip within an acousto-magnetic (AM) EAS tag thereby preventing the AM EAS tag from further resonating due to the change in magnetism.

However, according to some example embodiments, such a deactivator may also be leveraged to deactivate the tamper detection circuitry of an example security device as described herein. In this regard, upon detecting the deactivation field generated by the deactivator, the security device may be configured to implement a process that, in some instances, may conclude with the tamper alarm being disarmed to permit unlocking and removal of the alarm unit from a product, without sounding an alarm. Further, according to some example embodiments, the tamper detection circuitry of the security device may remain disarmed until a user (e.g., store personnel) takes steps to re-arm the security device. To detect the deactivator field, the security device may employ a receiving device in the form of a field sensor referred to herein as a deactivation sensor capable of detecting an electromagnetic field of a deactivator. Such a deactivation sensor may be, for example, an antenna that is implemented in the form of an inductor, a resonant circuit, a reed switch, a tunnel-magnetoresistance (TMR) sensor, or the like as described herein.

Additionally, an example security device may include an EAS tag (e.g., deactivatable or non-deactivatable) that is detectable by the deactivator and an EAS gate. An EAS gate is typically installed at the ingress and egress of a retail store. The EAS tag may be an RF tag (e.g., resonant at 8.2 or 4.8 MHz) or an AM tag (e.g., resonant at 58 kHz). The EAS tag may be configured to resonate and return a signal to, for example, an EAS gate when exposed to an electromagnetic field at the resonant frequency of the EAS tag. Upon detecting the EAS tag's return signal, the EAS gate may trigger a gate alarm to indicate that a possible theft may be occurring.

As such, according to some example embodiments, a security device is provided that leverages the functionality of a standard deactivator that is used to deactivate EAS tags to also disarm or deactivate the tamper detection circuitry of the security device. By employing such a security device, the deactivator may therefore offer dual functionality to assist in the implementation of both deactivatable EAS tags and reusable security devices in a retail environment, in accordance with some example embodiments. Further, by requiring the detection of the deactivator field prior to disarming the tamper detection circuitry, a security device, according to some example embodiments, may provide an added level of security relative to a device that merely requires, for example, a specialized magnetic key to mechanically unlock the device.

Figure 11:
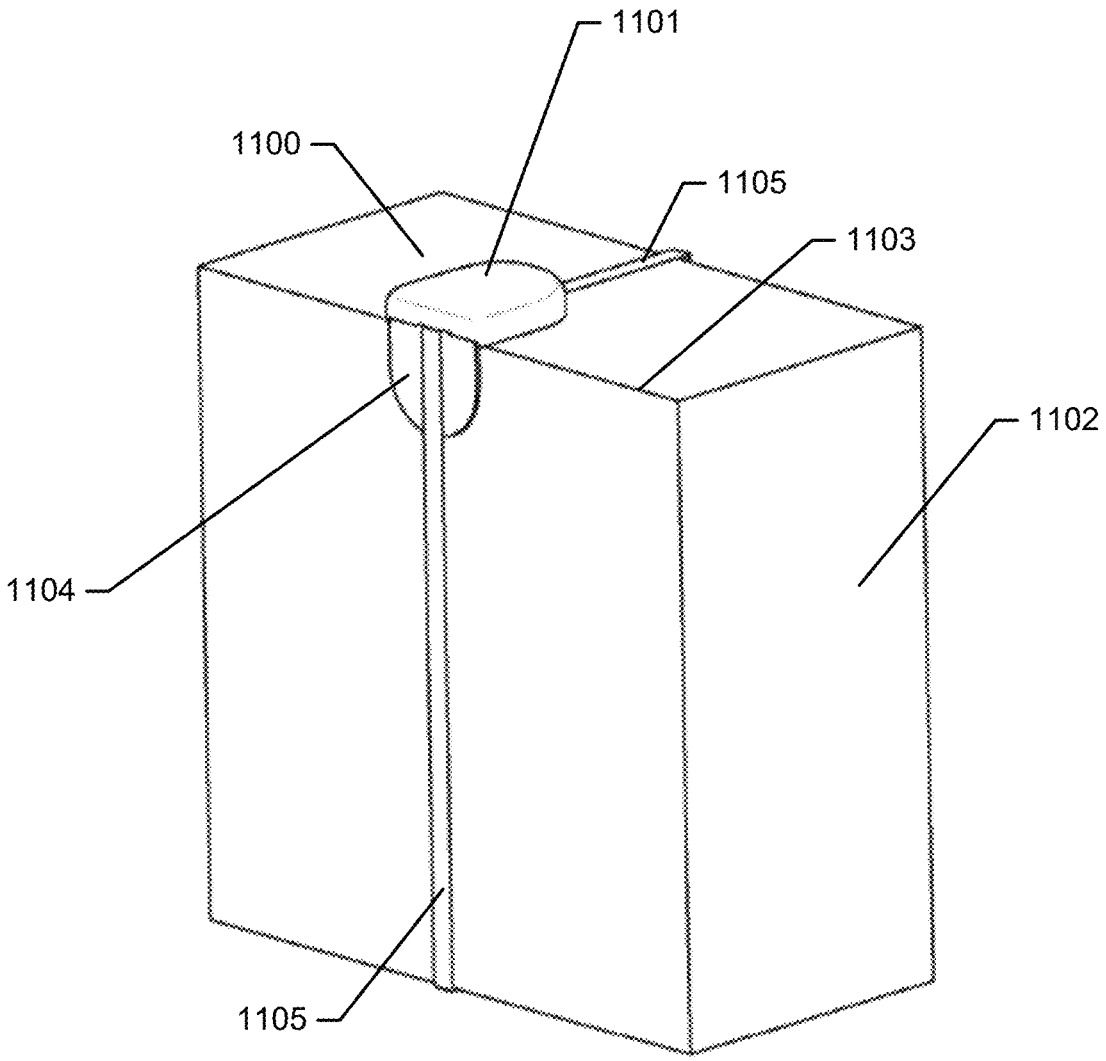
FIG. 11 illustrates an example security device affixed to an item according to some example embodiments.

In accordance with some example embodiments, FIG. 11 illustrates an example security device 1100 affixed to an item 1102 (e.g., a product). The security device 1100 may comprise, for example, an alarming unit 1101, a cleat 1104, and a conductive strip 1105. In this regard, the alarming unit 1101 may be, for example, physically and electrically connected to a conductive strip 1105. The alarming unit 1101 may be affixed to the item 1102 along an edge 1103 via a cleat 1104. Further, the conductive strip 1105 may loop around the item 1102 and be connected at each end to the alarming unit 1101 to form an electric circuit through the conductive strip 1105 back to the alarming unit 1101. The conductive strip 1105 may include at least a conductor such as aluminum that is continuously connected throughout a length of the conductive strip 1105. The cleat 1104 may be affixed to the item 1102 via, for example, an adhesive, and the alarming unit 1101 may be configured to mechanically lock onto the cleat 1104. The alarming unit 1101 may be configured to monitor the connectivity of the conductive strip 1105 and trigger a conductive loop alarm if discontinuity is introduced to the conductive strip 1105.

Figure 12:
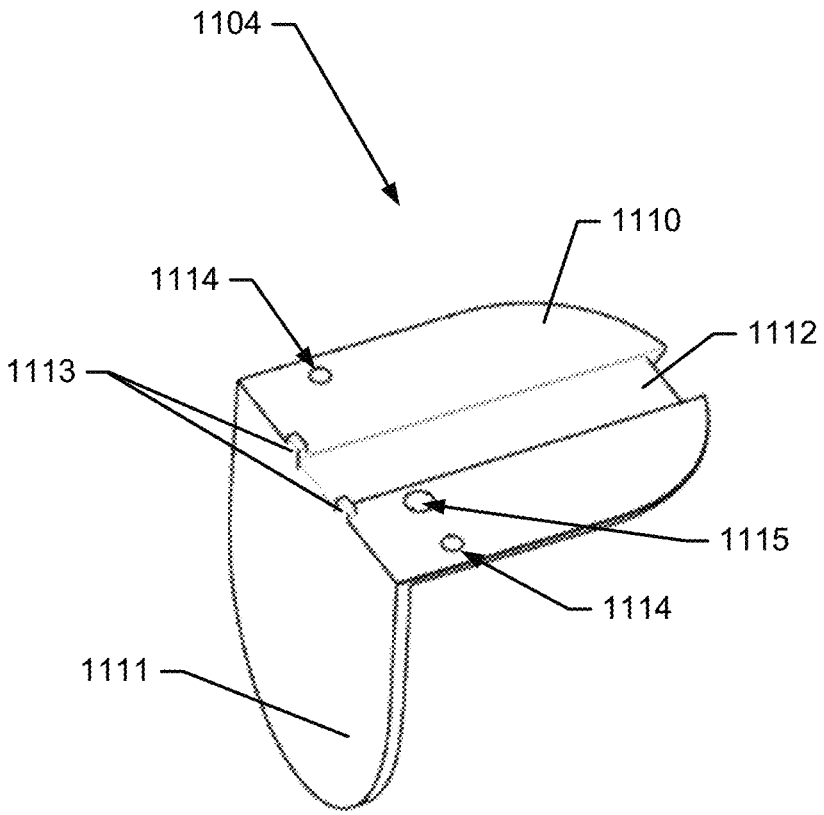
FIG. 12 illustrates an example cleat according to some example embodiments.

FIG. 12 illustrates an example cleat 1104 that can be used in conjunction with the security device 1100 and the alarming unit 1101. The cleat 1104 may be formed of, for example, plastic. The cleat 1104 may include a base plate 1110 and a side plate 1111. The base plate 1110 of the cleat 1104 may be oriented at a right angle or about a right angle to the side plate to facilitate attachment of the cleat 1104 to an edge of a box-shaped item or an item with a right angle edge. Since the base plate 1110 and the side plate 1111 may be affixed to a surface of an item via an adhesive (e.g., an adhesive strip), opening the box-shaped item may be inhibited by the application of the cleat 1104.

Further, the cleat 1104 may include a channel 1112 disposed on the base plate 1110. The channel 1112 may be positioned to receive the conductive strip 1105 and facilitate electrical connection with contacts on a bottom side of the alarming unit 1101. The base plate 1110 may also include lock openings 1114. Lock openings 1114 may be configured to receive locking pins or slugs of the alarming unit 1101 (described below) when the alarming unit 1101 is locked to the cleat 1104. Additionally, the cleat 1104 may include a tamper plunger opening 1115 that may be configured to permit a tamper plunger to pass through the tamper plunger opening 1115 to physically contact the item, when the alarming unit is in the locked position. As such, the tamper plunger opening 1115 may permit a tamper plunger of the alarming unit 1101 to extend and actuate an associated switch (e.g., tamper sensor, such as tamper sensor 220) within the alarming unit 1101 to detect removal of the alarming unit 1101 and the cleat 1104 from the item. Also, the base plate 1110 may include stops 1113. In this regard, the alarming unit 1101 may be configured to slide onto the base plate 1110 and the stops 1113 may be positioned to prevent further sliding motion beyond the locked position, when the alarming unit 1101 is being slid onto the base plate 1110.

Figure 13:
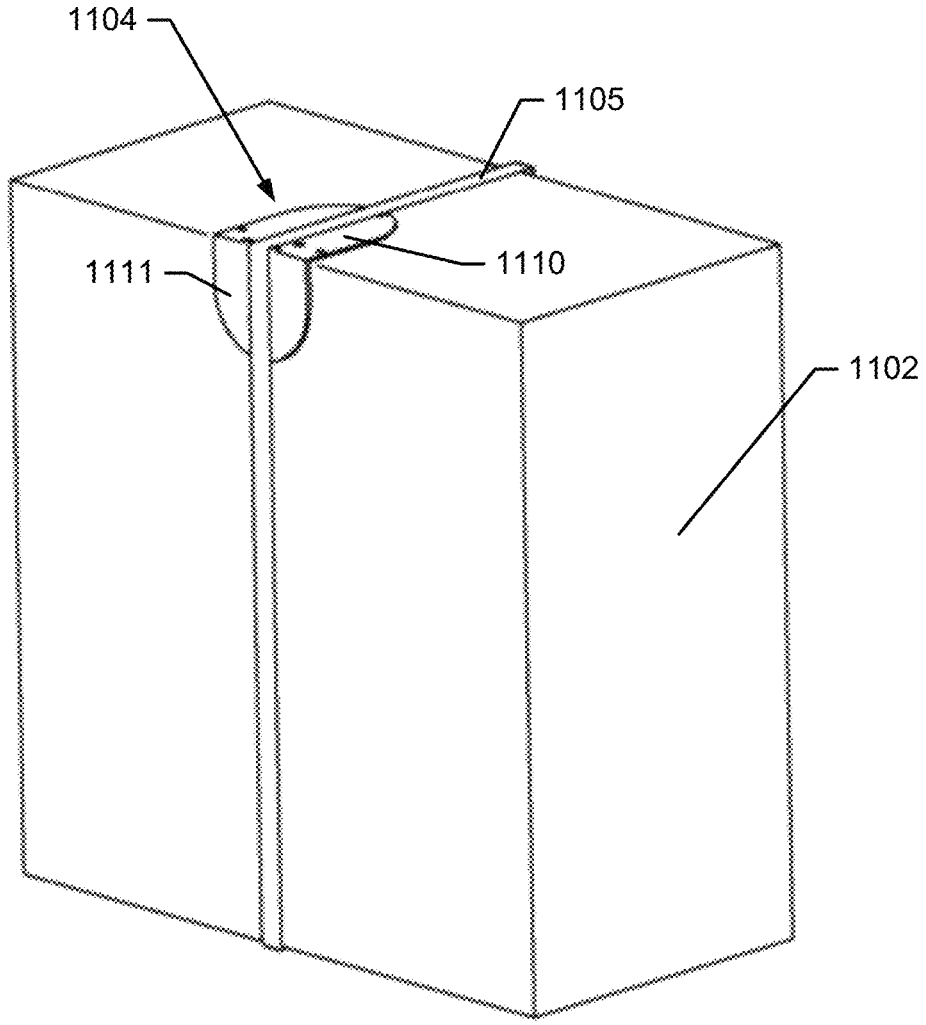
FIG. 13 illustrates an example cleat and a conductive strip applied to an item according to some example embodiments.

Referring now to FIG. 13, the item 1102 is shown with the cleat 1104 and the conductive strip 105 affixed. In this regard, cleat 1104 is affixed to an edge of the box-shaped item 1102, which may operate to deter opening the item 1102, for example, in a retail store to remove and steal the contents. Further, the conductive strip 1105 is shown as being wrapped around the item 1102. Although not shown in detail, the conductive strip 1105 may be disposed in the channel 1112 of the cleat 1104 to ensure proper alignment with contacts of the alarming unit 1101.

Figure 14:
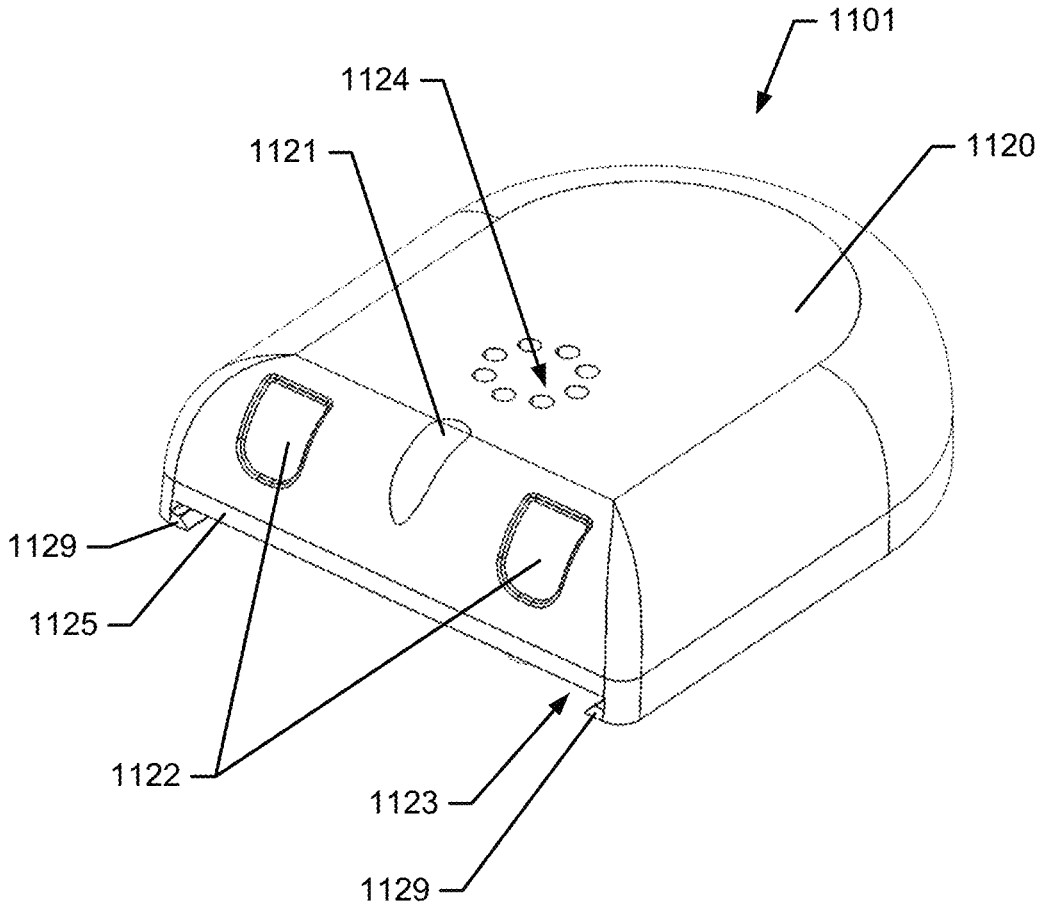
FIG. 14 illustrates a top perspective view of an alarming unit according to some example embodiments.

FIG. 14 illustrates a top perspective view of the alarming unit 1101. As shown in FIG. 14, the alarming unit 1101 may include housing comprising a housing cover 1120. The housing cover 1120 may partially house internal electrical and mechanical components that facilitate the operation of the alarming unit 1101. The housing cover 1120 may be formed of plastic and may have a concave shape. The housing cover 1120 may include an opening through which a light pipe 1121 for a light emitting diode (LED) may pass. The housing cover 1120 may include a speaker grill 1124 comprised of openings that permit sound generated by a sounder to escape from the internal cavity formed by the housing cover 1120 when the alarming unit 1101 is alarming.

The housing cover 1120 may also include, according to some example embodiments, key locators 1122. The key locators 1122 may be indentations in the housing cover 1120 configured to receive complementary prongs of a magnetic key that can be used to unlock a locking mechanism of the alarming unit 1101. Alternatively, according to some example embodiments, the alarming unit 1101 may include a push button rather than the key locators 1122. The push button may be configured to mechanically operate the locking mechanism to unlock the alarming unit 1101 from the cleat 1104 without a key (e.g., magnetic key) or other special tool.

The alarming unit 1101 may also include a bottom plate 1125, that together with the housing cover 1120 form the housing of the alarming unit 1101. The bottom plate 1125 may therefore couple with the housing cover 1120 to form an internal cavity for housing electronic and mechanical components. Additionally, the housing cover 1120 may include inward extending tabs 1129. The bottom plate 1125 may be disposed above the tabs 1129 to form a cleat receiving slot 1123 between the tabs 1129 and the bottom plate 1125. As such, the alarming unit 1101 may be configured to slide onto the cleat 1104 by engaging the cleat 1104 in the cleat receiving slot 1123 and sliding the alarming unit 1101 relative to the cleat 1104 that has been affixed to an item 1102.

Figure 15:
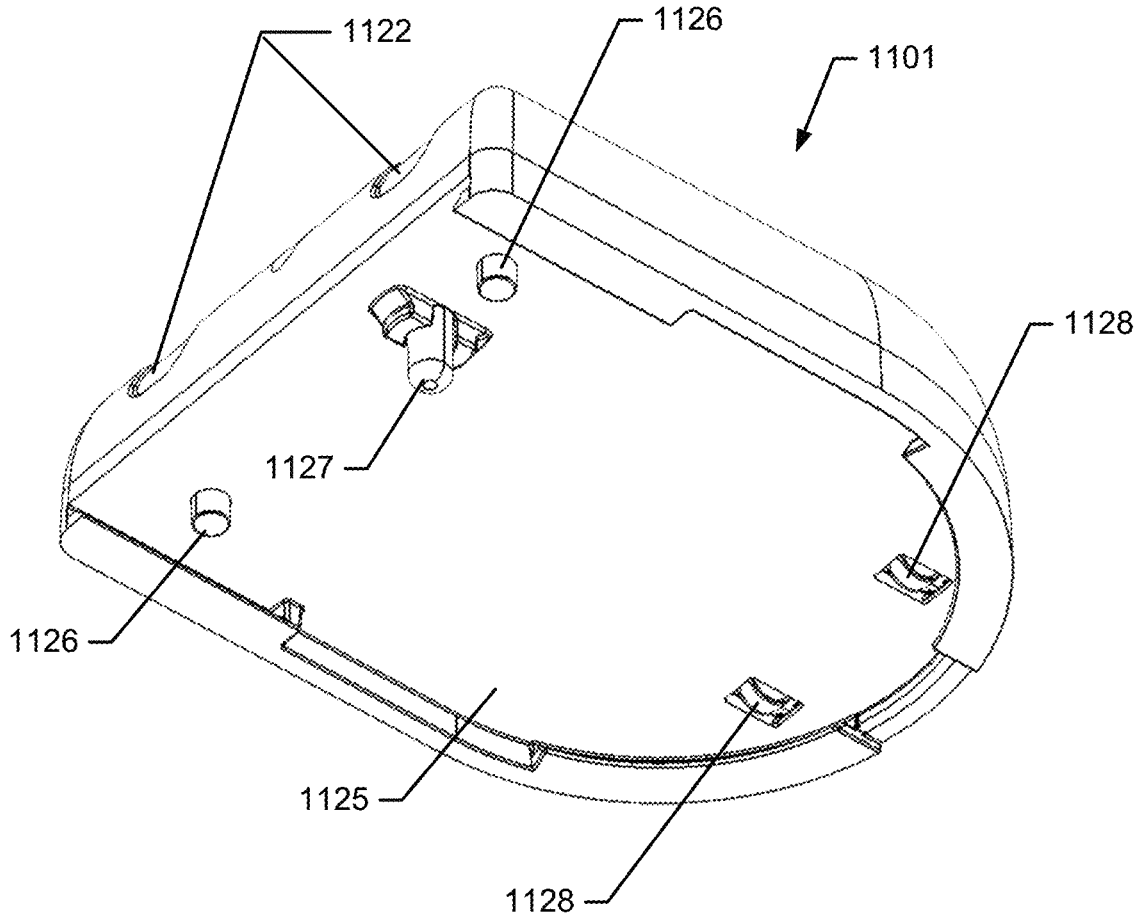
FIG. 15 illustrates a bottom perspective view of an alarming unit according to some example embodiments.

Now referring to FIG. 15, a bottom perspective view of the alarming unit 1101 is provided, where additional features of the bottom plate 1125 are visible. In this regard, the bottom plate 1125 may include various openings that support the operation of the alarming unit 1101 and the security device 1100. For example, the bottom plate 1125 may include openings to permit slugs 1126 to pass through to engage with and lock into openings 1114 of cleat 1104 when the alarming unit 1101 is in the locked position. In this regard, slugs 1126 may be comprised of a ferrous metal that is attracted to a magnet. As such, the slugs 1126 may be spring biased into an extended position. However, when a magnetic key is applied to the alarming unit 1101, the slugs 1126 may be pulled upward and into the internal cavity of the alarming unit 1101 to unlock the alarming unit 1101 from the cleat 1104 and permit removal of the alarming unit 1101 from the cleat 1104.

Additionally, the bottom plate 1125 may include an opening that a tamper plunger 1127 may pass through. In this regard, the tamper plunger 1127 may be sufficiently long enough to extend through an opening 1115 in the cleat 1104 to directly contact the item 1102. As further described below, the tamper plunger 1127 may be coupled to a tamper sensor to allow the alarming unit 1101 to detect when, for example, a potential thief is attempting to remove the alarming unit 1101 from the item 1102 by lifting the alarming unit 1101 and the cleat 1104 away from the surface of the item 1102.

Further, the bottom plate 1125 may include openings to permit tamper contacts 1128 to pass through and be exposed to contact the conductive strip 1105. In this regard, the tamper contacts 1128 may be configured to physically and electrically contact the conductive strip 1105 to form a circuit around the item 1102. As such, the security device 1100 may be configured to detect an break or discontinuity in the conductive strip 1105 since a connection between the tamper contacts 1128 will have been opened. The tamper contacts 1128 may be positioned such that the contacts align with ends of the conductive strip 1105 in order to form a loop through the conductive strip 1105 back to the alarming unit 1101.

Figure 16:
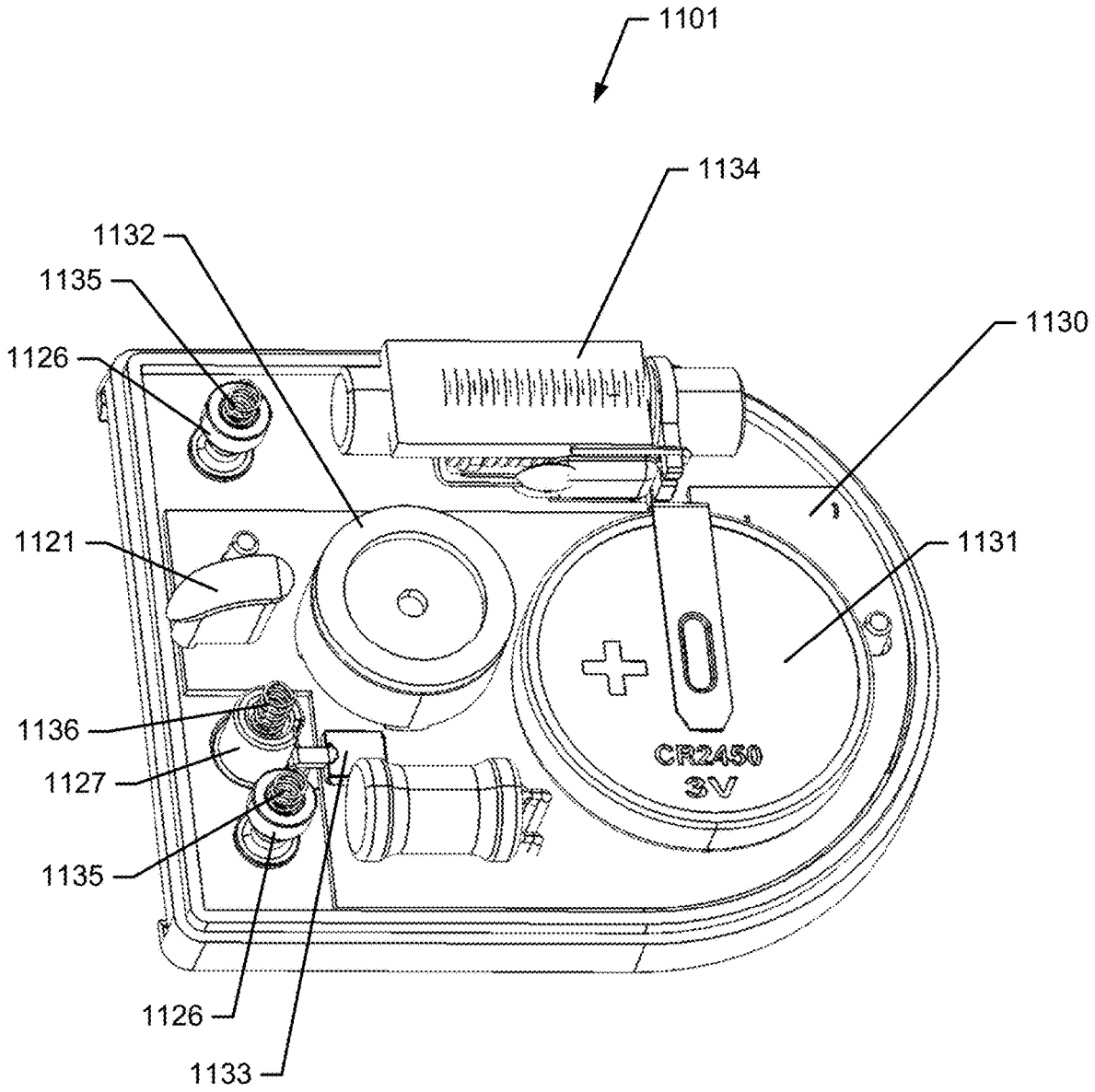
FIG. 16 illustrates a top perspective view of an alarming unit with a housing cover removed according to some example embodiments.

FIG. 16 shows a perspective view of the alarming unit 1101 with the housing cover 1120 removed to reveal some of the internal electrical and mechanical components of the alarming unit 1101. In this regard, with respect to some of the electrical components, alarming unit 1101 may include a circuit board 1130, a battery 1131, a sounder 1132, a tamper sensor 1133, and an EAS tag 1134. Further, electrical components may be disposed on the opposite, out-of-view side of the circuit board 1130, such as processing circuitry and a deactivation sensor. In this regard, as shown in FIG. 16, the battery 1131 and the sounder 1132 may be disposed on the circuit board 1130. Additionally, an LED and the light pipe 1121 may be disposed on the circuit board 1130.

The battery 1131 may be a power source (e.g., the same or similar to battery 260) that operates to provide electrical power to the various electrical components of the security device 1100, including processing circuitry as described below. The sounder 1132 may be any type of device that may be driven to produce an audible sound for an alarm (e.g., the same or similar to the sounder 240). In this regard, the sounder 1132 may be embodied as a speaker, piezoelectric sounder, or the like.

The tamper switch 1133 may operate with the tamper plunger 1127 to form a tamper sensor (as an example of tamper sensor 220) that can detect when the alarming unit 1101 is being pulled away from the item to which the security device 1100 is affixed. In this regard, the tamper switch 1133 may be operably coupled to the tamper plunger 1127 such that when the tamper plunger 1127 moves, an actuator of the tamper switch 1133 may actuate. Actuation of the tamper switch 1133 may generate a tamper signal to be detected by the alarming unit 1101 via processing circuitry as further described below. According to some example embodiments, the tamper plunger 1127 may be biased towards an extended position (e.g., extending downward) by spring 1136.

The EAS tag 1134 may be disposed within the internal cavity of the alarming unit 1101 and may be configured to operate as described above and otherwise herein. The EAS tag 1134 may be an RF tag (e.g., an RF label) or an AM tag (e.g., an AM chicklet). In some example embodiments, as shown in FIG. 16, the EAS tag 1134 may be disposed separate from the circuit board 1130 in the internal cavity of the alarming unit 1101. However, according to some example embodiments, the EAS tag 1134 may be disposed on the circuit board 1130. The EAS tag 1134 may be configured to resonate in the presence of an appropriate field to thereby send a return wireless signal for detection by an EAS gate or a deactivator as described herein.

Additional mechanical components are also shown in FIG. 16 that are part of a locking mechanism. In this regard, the slugs 1126 are shown, which, as described above, are configured to lock the alarming unit 1101 to the cleat 1104. Slugs 1126 may be biased into an extended position by respective springs 1135. As described above, the slugs 1126 may be magnetically attractable into a retracted position and out of engagement with the cleat 1104 by a magnetic key. With the slugs 1126 in the retracted position, the security device 1100 may be said to be in an unlocked state, and the alarming unit 1101 may be slid off and away from the cleat 1104.

Figure 17:
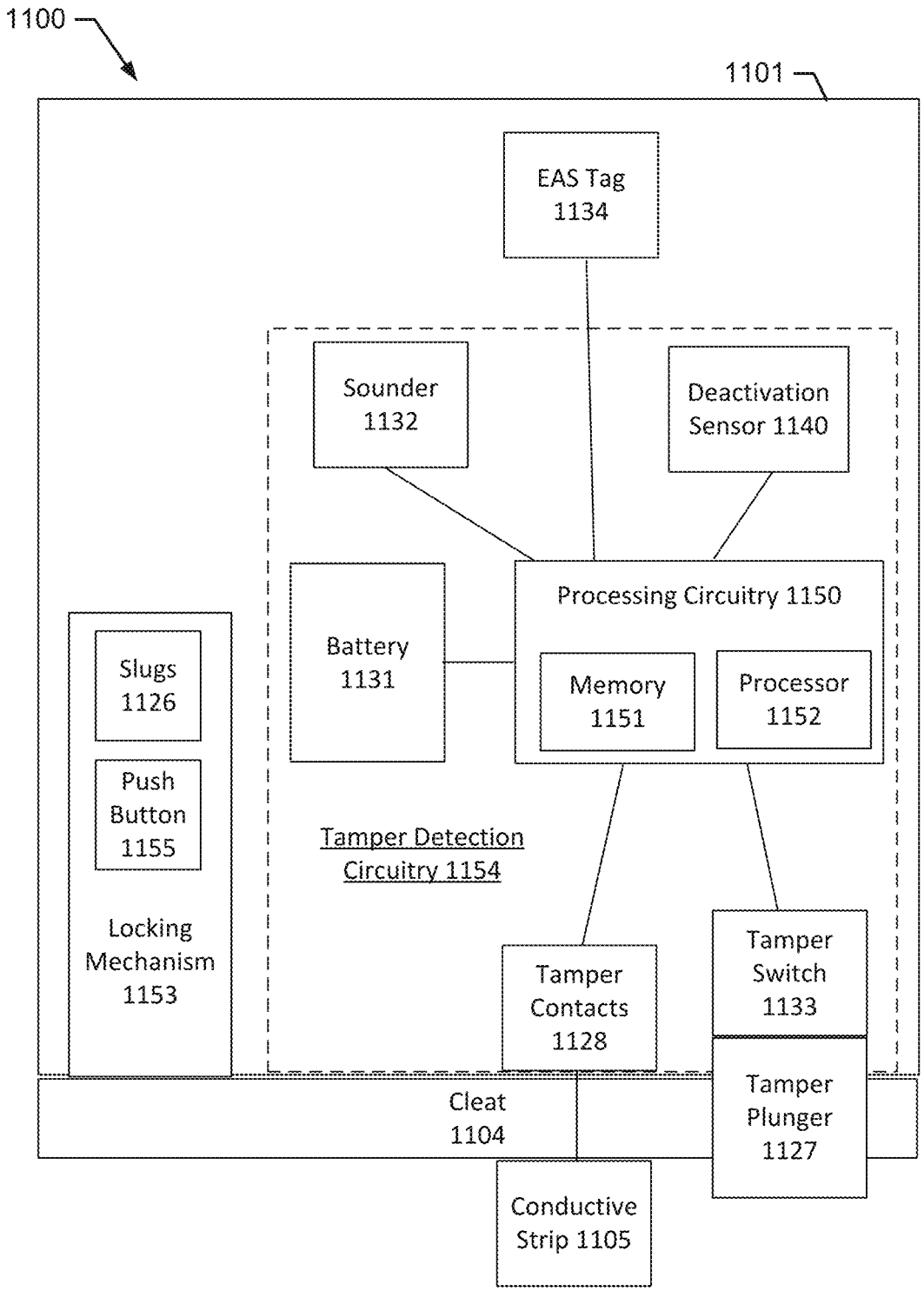
FIG. 17 illustrates a block diagram of a security device according to some example embodiments.

FIG. 17 illustrates a functional block diagram of the security device 1100 and various components thereof. In this regard, the security device 1100 as shown in FIG. 17 may include the alarming unit 1101, the cleat 1104, and the conductive strip 1105. The alarming unit 1101 may include tamper detection circuitry 1154, an EAS tag 1134, and a locking mechanism 1153.

The tamper detection circuitry 1154 may include the processing circuitry 1150 (e.g., including the memory 1151 and processor 1152), battery 1131, sounder 1132, deactivation sensor 1140, tamper contacts 1128, the tamper switch 1133, and the tamper plunger 1127. The sounder 1132 may be driven by the processing circuitry 1150 to cause an alarm to sound when triggered by the processing circuitry 1150. The battery 1131 may provide electrical power to electrical components of the alarming unit 1101 including the processing circuitry 1150. The tamper contacts 128 may be selectively connected to the conductive strip 1105 as described herein, and the tamper switch 1133 may be mechanically coupled to the tamper plunger 1127. According to some example embodiments, one of the tamper contacts 1128 may have a switch or contact that is depressed or actuated when the alarming unit 1101 is installed on the cleat 1104. This switch or contact may provide the processing circuitry 1150 with an indication that the alarming unit 1101 is installed in the cleat 1104, and this status may be used to determine operational behavior of the security device 1100. The locking mechanism 1153 may be configured to permit mechanical locking and unlocking of the alarming unit 1101 to the cleat 1104. As described above, the locking mechanism 1153 may be configured to operate with a key, such as magnetic key to permit unlocking of alarming unit 1101. Further, according to some example embodiments, the locking mechanism 1153 may include a push button 1155, slugs 1126, or other mechanical actuator that is configured to allow a user to unlock the alarming unit 1101. According to some example embodiments, such as where the push button 1155 is implemented, the alarming unit 1101 may be removed from the cleat 1104 without the use of a tool.

The alarming unit 1101 may also include a deactivation sensor 1140 electrically connected to the processing circuitry 1150. The deactivation sensor 1140 may be configured to detect an electromagnetic field, for example, generated by an EAS deactivator. In this regard, the deactivation sensor 1140 may be an antenna that is implemented in the form of an inductor, a resonant circuit, a reed switch, a tunnel-magnetoresistance (TMR) sensor, or the like. In this regard, the deactivation sensor 1140 may have an output in the form of a deactivation signal that is provided to the processing circuitry 1150 for evaluation. According to some example embodiments, the EAS tag 1134 may operate as the deactivation sensor 1140. In this regard, the processing circuitry 1150 may be connected to the EAS tag 1134 and the processing circuitry 1150 may be configured to detect resonant current in the EAS tag 1134 due to the presence of an EAS gate or deactivator field. According to some example embodiments, the deactivation sensor 1140 may be configured to detect a field generated by an EAS tag, such as EAS tag 1134. In this regard, for example, an AM deactivatable EAS tag may generate a magnetic field due to its magnetism. As such, the deactivation sensor 1140 may be configured to detect the absence of a field being generated by the AM deactivatable EAS tag after a deactivation, which may be used to trigger a deactivation of the tamper detection circuitry 1154. According to some example embodiments, as described herein, a deactivation sensor, such as the deactivation sensor 1140, may be configured to detect a deactivation field provided by an EAS deactivator. Additionally, the deactivation sensor 1140 and the EAS tag 1134, as separate components, may be housed within the housing of the alarming unit 1101.

The alarming unit 1101 may also include processing circuitry 1150. The processing circuitry 1150 may comprise a memory 1151 and a processor 1152. In this regard, the processor 1152 may be any type of processing device that is either hardware configured to perform defined functionalities (e.g., an field programmable gate array (FPGA) or an application specific integrated circuit (ASIC)) or the processor 1152 may be configured via execution of instructions (e.g., compiled software or firmware instructions), possibly stored in the memory 1151. The tamper detection circuitry 1154 and, more specifically the processing circuitry 1150, may be configured to perform various functionalities including those described in association with the flowchart of FIG. 18. In this regard, FIG. 18 provides a method that may be performed by the security device 1100, implemented as a reusable security device.

Figure 18:
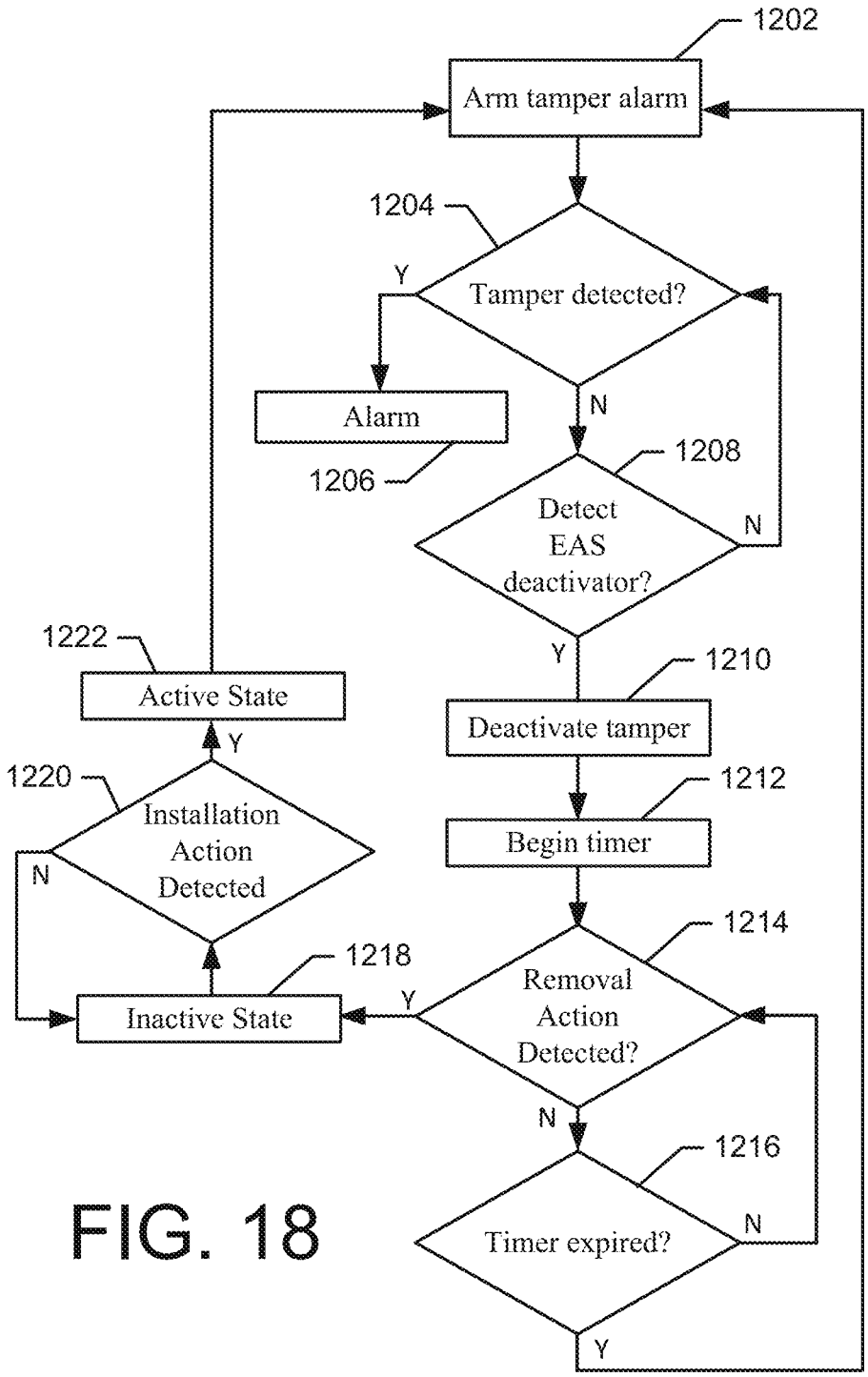
FIG. 18 illustrates a flowchart of an example method that may be implemented by a security device according to some example embodiments.

With reference to FIG. 18, at 1202, the tamper detection circuitry 1154 may be configured to arm the tamper detection circuitry 1154. To do so, the tamper detection circuitry 1154 may be configured to determine that the conductive strip 1105, for example, is installed on an item and forms a circuit to the tamper contacts 1128. The tamper detection circuitry 1154 may also be configured to detect that the tamper switch 1133 with the tamper plunger 1127 is depressed due to interaction with an item. By detecting that the conductive strip 1105 forms a circuit and that the tamper switch 1133 is actuated due depressing the tamper plunger 1127, the tamper detection circuitry 1154 may be configured to determine that the alarming unit 1101 has been locked into a cleat 1104 and has been installed on an item.

With the security device 1100 installed on a product, the tamper detection circuitry 1154, at 1204, may be configured to monitor and detect whether a tamper event has been detected or occurred as indicated by a tamper signal from a tamper sensor, which may be implemented via the combination of the tamper switch 1133 with the processing circuitry 1150 or the tamper contacts 1128 with the processing circuitry 1150. In this regard, the tamper detection circuitry 1154 may be configured to monitor the conductive strip 1105 for the occurrence of a tamper event and an associated tamper signal, where, for example, the tamper event may be a break or discontinuity in the circuit formed by the conductive strip 1105 with the tamper contacts 1128. The tamper detection circuitry 1154 may also be configured to monitor the tamper switch 1133 for the occurrence of a tamper event in the form of a tamper signal as indicated by an actuation of the tamper switch 1133 indicating that the alarming unit 1101 has been pulled away from an item by a sufficient distance. According to some example embodiments, the break or discontinuity in the conductive strip may be the result of applying a proper key (e.g., magnetic key) to the security device 1100 and removing the alarming unit 1101 from the cleat 1104 prior to the alarming unit 1101 detecting a deactivation field, either of which may cause a tamper event.

If the tamper detection circuitry 1154 detects a tamper event as indicated by a tamper signal from a tamper sensor, then the tamper detection circuitry 1154 may be configured to sound an alarm at 1206. In this regard, the tamper detection circuitry 1154 may be configured to drive the sounder 1132 to cause and audible alarm in response to the tamper event.

If, however, no tamper event is detected by the tamper detection circuitry 1154, the tamper detection circuitry 1154 may, at 1208, be further configured to monitor for the detection of an EAS deactivator, for example, at a POS. In this regard, if no EAS deactivator is detected, then the tamper detection circuitry 1154 may be configured to revert back to monitoring for a tamper event or a deactivation field which may be repeated until either a tamper event is detected or a deactivator field is detected.

Figure 19:
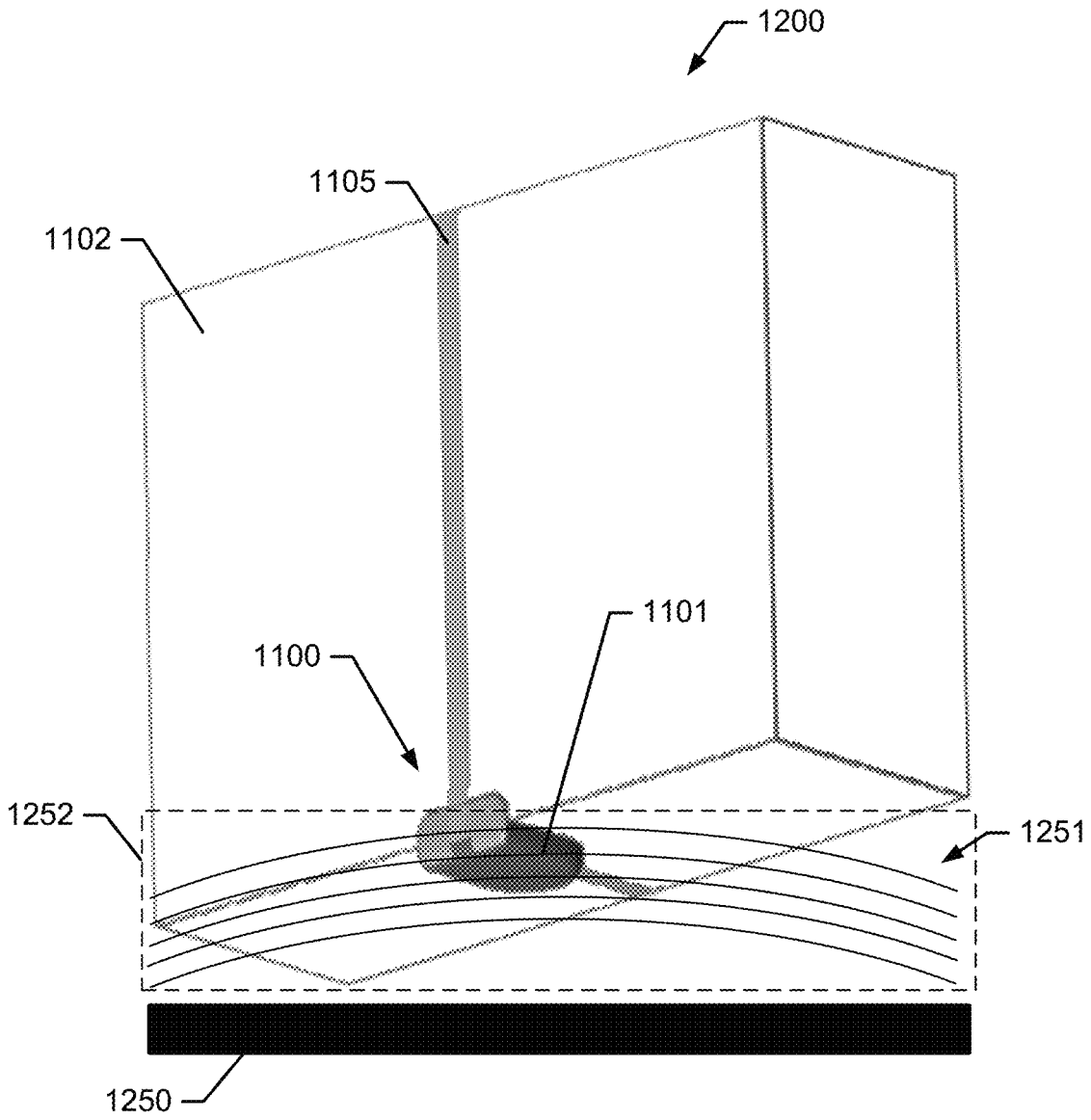
FIG. 19 illustrates a security device affixed to an item, where the alarming unit is located in a deactivation field of a deactivator according to some example embodiments.

If, however, the tamper detection circuitry 1154 does detect an EAS deactivator via the deactivation sensor 1140, the tamper detection circuitry 1154 may be configured to, at 1210, disarm or deactivate tamper detection circuitry and associated functionality to permit removal of the alarming unit 1101 from the cleat 1104, and the item being protected, without sounding the alarm. In this regard, FIG. 19 illustrates an example system 1200 including security device 1100 and a deactivator 1250 generating a deactivation field 1251 according to some example embodiments. As such, the security device 1100 is being subjected to the deactivation field 1251, presumably at a POS. According to some example embodiments, the deactivation field 1251 may be provided by the deactivator 1250 in response to detecting the presence of the EAS tag 1134 of the security device 1100.

According to some example embodiments, to detect an EAS deactivator, the tamper detection circuitry 1154 of the security device 1100 may be configured to detect characteristics of the deactivation field. These characteristics may be different than those of a field, for example, generated by an EAS gate at an exit of a retail store, and therefore the tamper detection circuitry 1154 may be configured to differentiate between a deactivation field and a gate field. Therefore, the tamper detection circuitry 1154 may be able to trigger functionality based on the detection of a deactivation field, such as deactivating the tamper detection circuitry. According to some example embodiments, the tamper detection circuitry 1154 may be configured to leverage the deactivation sensor 1140 to detect relatively high power pulses, at a given rate and at one or more given frequencies that would indicate the presence of an EAS deactivator attempting to deactivate, for example, an RF EAS tag. Alternatively, the tamper detection circuitry 1154 may be configured to leverage the deactivation sensor 1140 to detect a deactivation field in the form of a degaussing field that oscillates at a given frequency (e.g., 800 Hz) and then decays in power over time (e.g., 25% decay rate), which would indicate the presence of an EAS deactivator attempting to deactivate, for example, an AM EAS tag. Further, according to some example embodiments, the deactivation sensor 1140 may be configured and positioned within the alarming unit 1101 to detect changes in the deactivator field caused by presence of an EAS tag to determine the presence of an EAS deactivator. Further, the deactivation sensor 1140 may be configured to detect a field generated by magnetism of a deactivatable AM EAS tag housed within the alarming unit 1101. In this regard, when such a deactivatable AM EAS tag is subjected to a deactivation field, the deactivatable AM EAS tag may become demagnetized. As such, the field sensor 1140 may no longer detect the field of the deactivatable AM EAS tag, which is indicative of the presence of an EAS deactivator.

Referring again to FIG. 18, the tamper detection circuitry 1154 may be configured to begin a timer at 1212 in response to detection of the EAS deactivator. In this regard, the tamper detection circuitry 1154 may be configured to begin a timer in response to deactivation of the tamper detection circuitry 1154 due to detection of the deactivation field. The timer may run for a period of time (e.g., 30 seconds) to provide time for store personnel to, for example, apply a key (e.g., a magnetic key) to the security device 1100 to unlock the alarming unit 1101 and remove the alarming unit 1101 from the cleat 1104 and the item without sounding the alarm. As such, at 1214, the tamper detection circuitry 1154 may be configured to detect if the removal of the security device 1100 has taken place. In this regard, detecting removal of the security device 1100 may include detecting that, subsequent to detection of the deactivator field, a removal action has taken place as indicated by the tamper sensor. For example, the tamper sensor may indicate a removal action has occurred when, for example, the circuit to the tamper contacts 1128 has been broken or discontinued or detecting that the tamper switch 1133 has been actuated. If, however, removal of the security device 1100 has not been detected, then the tamper detection circuitry 1154 may be configured, at 1216, to determine whether the timer has expired. If the timer has not expired and a tamper sensor has not indicated removal, then the tamper detection circuitry 1154 may be configured to continuously monitor for a removal action and expiration of the timer. If however, the timer does expire without detection of a removal action, then the tamper detection circuitry 1154 may be configured to re-arm the tamper detection circuitry 1154 at 1202. As such, the tamper detection circuitry 1154 may be further configured to detect, via a tamper sensor, that a removal action has not occurred prior to the timer expiring and, in response to the timer expiring, arm the tamper detection circuitry 1154.

However, if a removal action is detected, then at 1218, the security device 1100 may enter an inactive state. In this regard, prior to the timer expiring, store personnel have removed the alarming unit 1101 from the item. As such, the security device 1100 is no longer protecting an item and the alarming unit 1101 may be stored for reuse on another item. However, at 1220, the tamper detection circuitry 1154 may be configured to monitor for detection of an installation action of the alarming unit 1101 (e.g., on a new product for sale). In this regard, the tamper detection circuitry 1154 may be configured to detect from a tamper sensor that an installation action has been taken. An installation action may be indicated by detecting that a circuit has been formed between the tamper contacts 1128 (e.g., via the conductive strip 1105) and that the tamper plunger 1127 has been depressed to actuate the tamper switch 1133 to indicate that the alarming unit 1101 has been installed. If the alarming unit 1101 has not been installed, then the tamper detection circuitry 1154 may be configured to repeatedly monitor for detection of an installation action. Alternatively, if the installation of the alarming unit 1101 is detected by the tamper detection circuitry 1154, then the alarming unit 1101 may transition back into an active state at 1222 and proceed to arm the tamper detection circuitry 1154 at 1202. As such, the tamper detection circuitry 1154 may be further configured to detect, via a tamper sensor, that an installation action has occurred and, in response, arm the tamper detection circuitry 1154 for tamper signal detection at 1204 and responsive alarming at 1206.

Although the flowchart of FIG. 18 is indicative of the operation of a reusable security device, a subset of the operations shown in FIG. 18 may be indicative of the operation of a disposable security device. In this regard, the tamper detection circuitry 1154 may be in the inactive state 1218 awaiting an installation action. As described above, if no installation action is detected, then the tamper detection circuitry 1154 may remain in the inactive state at 1218. However, if an installation action is detected, then the tamper detection circuitry 1154 may enter the active state at 1222 and the tamper detection circuitry 1154 may be armed at 1202. Subsequently, the tamper detection circuitry 1154 may monitor for a tamper event at 1204 and alarm at 1206 if a tamper event is detected. If no tamper event is detected, then the tamper detection circuitry 1154 may monitor for detection of an EAS deactivator. If no EAS deactivator is detected, the processing circuitry may again monitor for a tamper event at 1204. If an EAS deactivator is detected, the tamper detection circuitry 1154 may deactivate the tamper detection circuitry 1154. Having deactivated the tamper detection circuitry 1154 and the deactivatable EAS tag due to the exposure to the deactivation field, the process may end at 1210 and the product with the security device 1100 affixed thereto can be removed or moved through the EAS gates without triggering a local alarm or a gate alarm, respectively.

Figure 20:
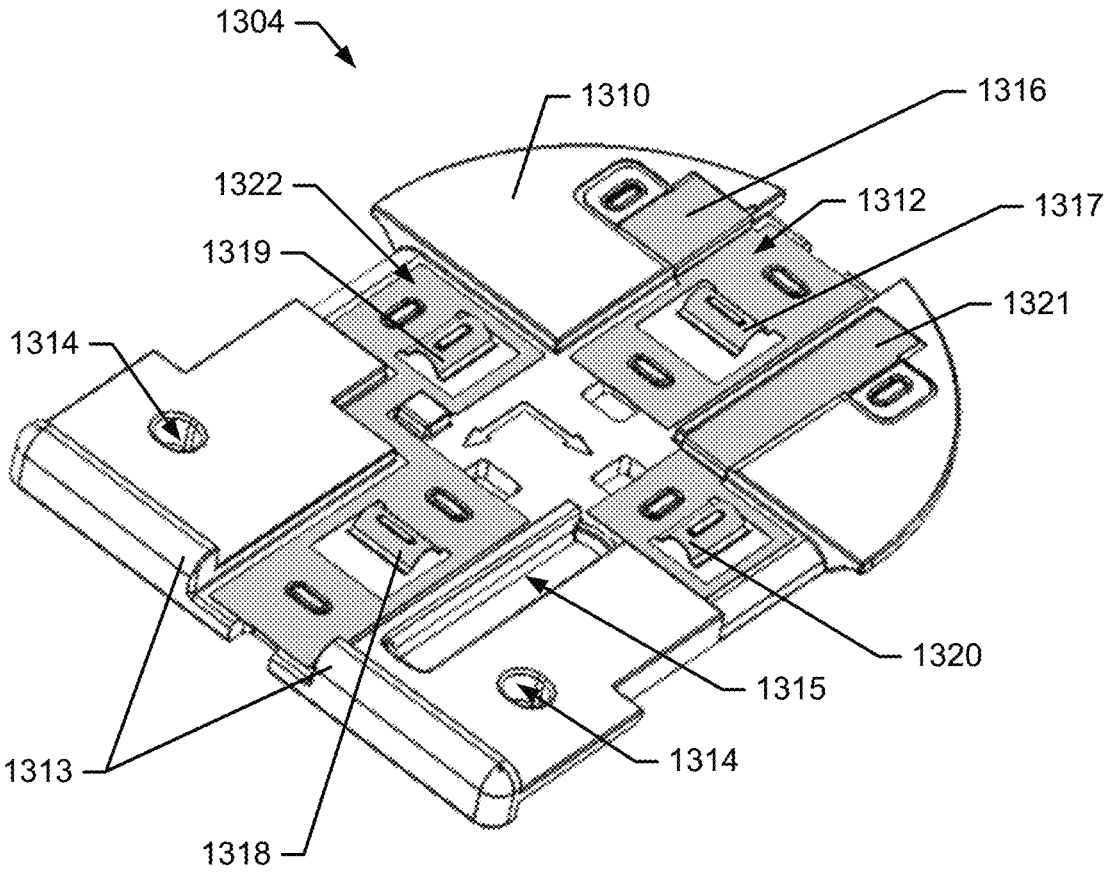
FIG. 20 illustrates an example crossover cleat according to some example embodiments.

Additionally, FIG. 20 shows an alternative cleat in the form of crossover cleat 1304 that may be utilized in accordance with various example embodiments. The crossover cleat 1304 operates similar to cleat 1104 with respect to providing a base upon which the alarming unit 1101 may be affixed by sliding the alarming unit 1101 onto the crossover cleat 1304. In this regard, crossover cleat 1304 may be formed of, for example, plastic. The crossover cleat 1304 may include a base plate 1310. Unlike the cleat 1104, the crossover cleat 1304 may be placed in locations on an item that are not necessarily on an edge to facilitate more central positioning of the conductive strip 1105. The base plate 1310 of the crossover cleat 1304 may be affixed to a surface of an item via an adhesive (e.g., an adhesive strip) disposed on a bottom side of the crossover cleat 1304.

Further, the crossover cleat 1304 may include channels 1312 and 1322 disposed on the base plate 1310. The channels 1312 and 1322 may be positioned to receive the conductive strip 1105 and facilitate electrical connection with contacts on a bottom side of the alarming unit 1101. In this regard, the channels 1312 and 1322 may be oriented in a perpendicular fashion to facilitate wrapping the conductive strip 1105 around an item as a single strip that forms a crossover on the side of the item opposite the affixed crossover cleat 1304, or two separate conductive strips 1105 may be used to form two loops that are connected into separate sets of contacts on the alarming unit 1101.

The base plate 1310 may also include lock openings 1314. Lock openings 1314 may be configured to receive locking pins or slugs of the alarming unit 1101 (described above) when the alarming unit 1101 is locked to the crossover cleat 1304. Additionally, the crossover cleat 1304 may include a tamper plunger groove 1315 that may be configured to permit a tamper plunger to pass through the tamper plunger groove 1315 to rest within the cleat 1304 in an extended position or physically contact the item, when the alarming unit 1101 is in the locked position. As such, the tamper plunger groove 1315 may permit a tamper plunger of the alarming unit 1101 to extend and actuate an associated switch within the alarming unit 1101 to detect removal of the alarming unit 1101 and the crossover cleat 1304 from the item. Also, the base plate 1310 may include stops 1313. In this regard, the alarming unit 1101 may be configured to slide onto the base plate 1310 and the stops 1313 may be positioned to prevent further sliding motion beyond the locked position, when the alarming unit 1101 is being slid onto the base plate 1310.

In example embodiments where the crossover cleat 1304 uses two separate conductive strips, contacts and connections on the crossover cleat 1304 may form the two separate conductive strips into a single continuous electrical loop. In this regard, the crossover cleat 1304 may include cleat contact pads 1316 and 1321, both of which are formed of a conductive material, such as, a metal (e.g., aluminum). The crossover cleat 1304 may also include conductive strip connectors 1317, 1318, 1319, and 1320. The conductive strip connectors 1317, 1318, 1319, and 1320 may be raised portions of metal that have been formed into convex leaf springs to facilitate forming a reliable, pressure connection between the conductive strip and the conductive strip connectors 1317, 1318, 1319, and 1320 due to pressure applied on the conductive strip connectors 1317, 1318, 1319, and 1320 by the alarming unit 1101.

The cleat contact pads 1316 and 1321, the conductive strip connectors 1317, 1318, 1319, and 1320, and the two conductive strips may form one continuous electrical connection. This continuous electrical connection may be connected between the contacts 1128 of the alarming unit 1101. To do so, the connection may begin at cleat contact pad 1316, which may be connected to one of the contacts 1128 when the alarming unit 1101 is installed on the crossover cleat 1304. The cleat contact pad 1316 may be electrically connected to conductive strip connector 1317, which in turn may be connected to one end of a first conductive strip. The other end of the first conductive strip may be connected to the conductive strip connector 1318. Conductive strip connector 1318 may be electrically connected, on the crossover cleat 1304, to the conductive strip connector 1319. Conductive strip connector 1319 may be connected to one end of a second conductive strip. The other end of the second conductive strip may be connected to the conductive strip connector 1320. Conductive strip connector 1320 may be electrically connected, on the crossover cleat 1304, to the cleat conductive pad 1321. Cleat conductive pad 1321 may be connected to the other one of the contacts 1128 when the alarming unit 1101 is installed on the crossover cleat 1304.

Figure 21:
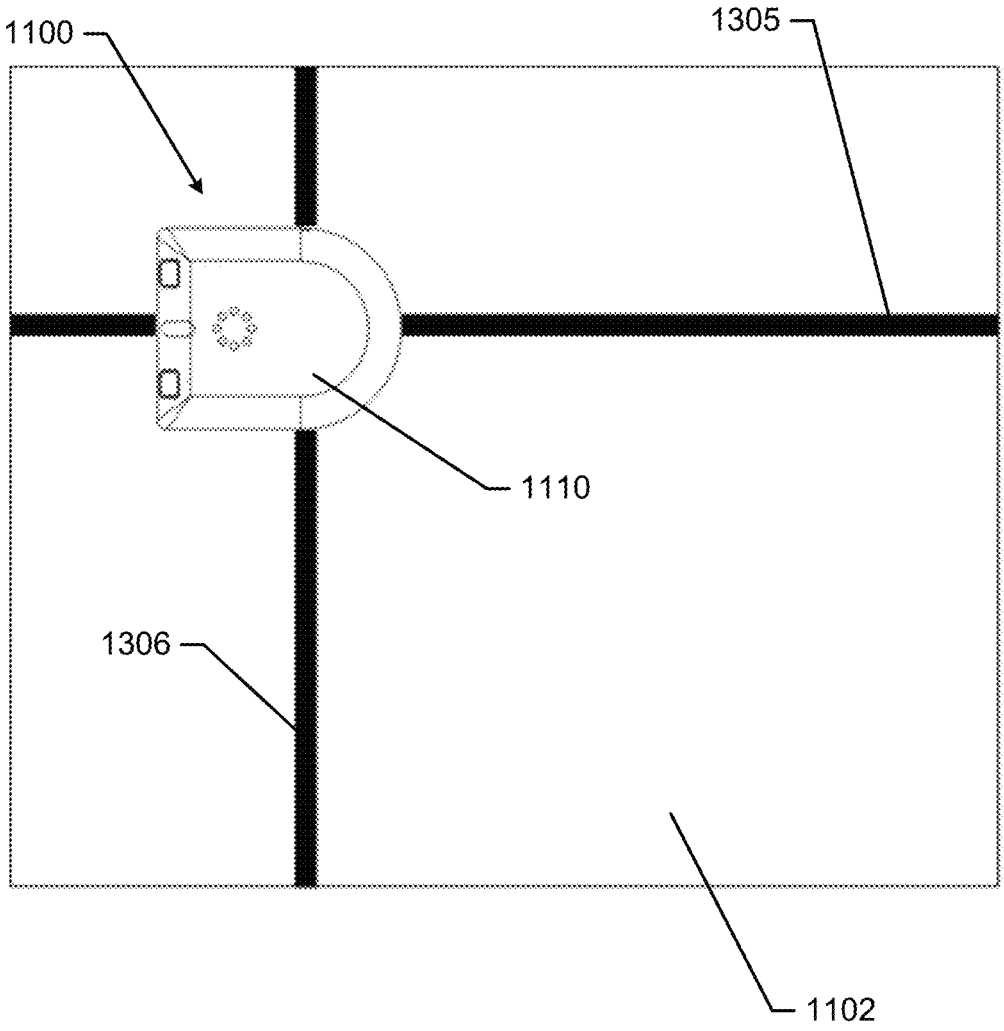
FIG. 21 illustrates an example implementation of a security device using a crossover cleat and two conductive strips according to some example embodiments.

FIG. 21 shows the security device 1100 with alarming unit 1101 installed on the crossover cleat 1304 on the item 1102. As can be seen in FIG. 21, the conductive strip 1305 may be wrapped around the item 1102 in a first direction and connected into the crossover cleat 1304. The conductive strip 1306 may be wrapped around the item 1102 in a second direction, that is perpendicular to the first direction, and connected into the crossover cleat 1304.

As described herein, the security device 1100 and the alarming unit 1101 may be configured to monitor tamper detection circuitry including a conductive strip that forms a loop. In this regard, when the loop is severed, the tamper detection circuitry may trigger an alarm. According to some example embodiments, the sense loop may take on a number of forms with one or both ends being mechanically lockable into the alarming unit 1101. In this regard, the sense loop may be formed by a cable or multiple cables that may be wrapped around an item or the cables may be passed through an opening in the item. Further, in some example embodiments, the loop may include a series switch that is closed when the alarming unit 1101 is affixed to an item and open when the alarming unit 1101 is removed from the item. In this regard, example embodiments with a series switch in the loop may be implemented in the form of an alarming hard tag or a safer-type lockable box.

The following provides some additional example embodiments in view of the description provided herein. In this regard, according to some example embodiments, a security device is provided. The security device may comprise a housing, an article surveillance tag, and tamper detection circuitry. The electronic article surveillance tag may be disposed in the housing, and may be configured to resonate to provide a wireless response signal to a deactivator to trigger generation of a deactivation field by the deactivator and resonate to provide the wireless signal to a gate to trigger a gate alarm in response to a gate field. The tamper detection circuitry may be disposed within the housing, and the tamper detection circuitry may comprise a tamper sensor configured to generate a tamper signal in response to detecting a tamper event, a deactivation sensor configured to generate a deactivation signal in response to detecting the deactivation field, and a sounder. In this regard, the tamper detection circuitry may be configured to trigger the sounder to emit an alarm sound in response to receiving the tamper signal from the tamper sensor when the tamper detection circuitry, and deactivate the tamper detection circuitry in response to receiving the deactivation signal from the deactivation sensor such that receipt of the tamper signal after deactivation of the tamper detection circuitry does not trigger the sounder to emit the alarm. According to some example embodiments, the electronic article surveillance tag may be configured to deactivate in response to being disposed within the deactivation field. Additionally or alternatively, the deactivation field may have at least a threshold power to deactivate the electronic article surveillance tag. Additionally or alternatively, the deactivation sensor may be configured to generate the deactivation signal in response to detecting the deactivation field having at least the threshold power. Additionally or alternatively, the electronic article surveillance tag and the deactivation sensor may be tuned to a frequency of the deactivation field. Additionally or alternatively, the frequency of the deactivation field may be the same as a frequency of the gate field. Additionally or alternatively, the tamper detection circuitry may be further configured to begin a timer in response to deactivation of the tamper detection circuitry due to detection of the deactivator field. Additionally or alternatively, the tamper detection circuitry may be further configured to detect, via the tamper sensor, that a removal action has not occurred prior to the timer expiring and, in response to the timer expiring, arm the tamper detection circuitry. Additionally or alternatively, the tamper detection circuitry may be further configured to detect, via the tamper sensor, that an installation action has occurred and, in response, arm the tamper detection circuitry. Additionally or alternatively, the deactivation sensor may comprises a tunnel-magnetoresistance sensor. Additionally or alternatively, the tamper sensor may be configured to generate the tamper signal in response to detecting the tamper event. The tamper event may be a severing of a conductive strip that is electrically connected to the tamper sensor to form a loop. Additionally or alternatively, the tamper sensor may comprise two electrical contacts, and the conductive strip may be electrically connected between the two electrical contacts. Additionally or alternatively, the two electrical contacts may comprise flexible tabs configured to extend through respective openings in a product packaging surface to enable application of the security device on an internal face of the product packaging surface while the flexible tabs are accessible for electrical connection on an external face of the product packaging surface. Additionally or alternatively, the conducive strip may comprise a backing and a conductor. The conductor may be affixed to the backing such that the conductor is exposed to form an electrical connection on a first side of the backing and insulated from forming an electrical connection on a second side of the backing. Additionally or alternatively, the tamper detection circuitry may further comprise a light and the tamper detection circuitry may be configured to illuminate the light based on the tamper detection circuitry being active or deactivated. Additionally or alternatively, a frequency of the deactivation field and the gate field may be about 8.2 MHZ, 4.8 MHz, or 58 kHz. Additionally or alternatively, the security device may further comprise an adhesive to affix the security device to product packaging.

According to some example embodiments, another security device is provided. The security device may comprise a housing, an article surveillance tag, and tamper detection circuitry. The electronic article surveillance tag may be disposed in the housing, and may be configured to resonate to provide a wireless response signal to a deactivator to trigger generation of a deactivation field by the deactivator and resonate to provide the wireless signal to a gate to trigger a gate alarm in response to a gate field. The tamper detection circuitry may be disposed within the housing, and the tamper detection circuitry may comprise a tamper sensor configured to generate a tamper signal in response to detecting a tamper event, a deactivation sensor configured to generate a deactivation signal in response to detecting the deactivation field, and a sounder. The tamper event may be a severing of a conductive strip that is electrically connected to the tamper sensor to form a loop. In this regard, the tamper detection circuitry may be configured to trigger the sounder to emit an alarm sound in response to receiving the tamper signal from the tamper sensor when the tamper detection circuitry, and deactivate the tamper detection circuitry in response to receiving the deactivation signal from the deactivation sensor such that receipt of the tamper signal after deactivation of the tamper detection circuitry does not trigger the sounder to emit the alarm. Further, the electronic article surveillance tag and the deactivation sensor may be tuned to a frequency of the deactivation field. According to some example embodiments, a frequency of the deactivation field and the gate field may be about 8.2 MHZ, 4.8 MHz, or 58 kHz.

According to some example embodiments, a method is provided. The method may include resonating, by an electronic article surveillance tag disposed within a housing of a security device, to provide a wireless response signal to a deactivator to trigger generation of a deactivation field by the deactivator. The method may further include receiving, by the electronic article surveillance tag, the deactivation field from a deactivator, and simultaneously receiving, by a deactivation sensor disposed within the housing of the security device, the deactivation field. The method may also include in response to simultaneously receiving the deactivation field by the deactivation sensor, deactivating tamper detection circuitry of the security device such that receipt of a tamper signal after deactivation of the tamper detection circuitry does not trigger a sounder to emit the alarm. According to some example embodiments, the deactivation sensor may comprise a reed switch or a tunnel-magnetoresistance sensor. Additionally or alternatively, a frequency of the deactivation field is about 8.2 MHZ, 4.8 MHz, or 58 kHz.

Many modifications and other embodiments set forth herein will come to mind to one skilled in the art to which these inventions pertain having the benefit of the teachings presented in the foregoing descriptions and the associated drawings. Therefore, it is to be understood that the embodiments are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A security device comprising:

a tag device configured to:

transmit a wireless signal at a particular frequency in response to a deactivation field of a deactivator provided at the particular frequency to trigger the deactivator to increase a power of the deactivation field as part of a tag deactivation process, and transmit a wireless signal at the particular frequency in response to a gate field of a gate provided at the particular frequency to trigger a gate alarm; and tamper detection circuitry comprising:

a tamper sensor, a deactivation sensor, and a sounder;

wherein the tamper sensor is configured to generate a tamper signal in response to detecting a tamper event, the tamper signal triggering the sounder to emit an alarm sound;

wherein the deactivation sensor is configured to detect the increased power of the deactivation field, at the particular frequency, over a threshold and, in response, disable the triggering of the sounder to emit the alarm sound.

2. The security device of claim 1, wherein the deactivation sensor comprises a resonant circuit.

3. The security device of claim 1, wherein the tamper detection circuitry is further configured to begin a timer in response to disabling the triggering of the sounder.

4. The security device of claim 3 wherein the tamper detection circuitry is further configured to detect, via the tamper sensor, that a removal action has not occurred prior to the timer expiring and, in response to the timer expiring, arm the tamper detection circuitry.

5. The security device of claim 1 wherein the tamper detection circuitry is further configured to detect, via the tamper sensor, that an installation action has occurred and, in response, arm the tamper detection circuitry.

6. The security device of claim 1, wherein the tamper sensor is configured to generate the tamper signal in response to detecting the tamper event, the tamper event being a severing of a conductor that is electrically connected to the tamper sensor to form a loop.

7. The security device of claim 6, wherein the tamper sensor comprises two electrical contacts, and wherein the conductor is electrically connected between the two electrical contacts.

8. The security device of claim 7, wherein the two electrical contacts comprise flexible tabs configured to extend through respective openings in a product packaging surface to enable application of the security device on an internal face of the product packaging surface while the flexible tabs are accessible for electrical connection on an external face of the product packaging surface.

9. The security device of claim 1, wherein the tamper detection circuitry further comprises a light and the tamper detection circuitry is configured to illuminate the light based on the tamper detection circuitry being active or deactivated.

10. The security device of claim 1, wherein the particular frequency is about 8.2 MHZ, 4.8 MHz, or 58 kHz.

11. The security device of claim 1 further comprising an adhesive to affix the security device to product packaging.

12. The security device of claim 1, wherein the tag device is a non-deactivatable electronic article surveillance tag.

13. A security device to be coupled with a product in a retail store, the security device comprising:

a deactivation sensor;

a sounder; and a tag device configured to transmit a wireless signal at a particular frequency in response to:

a deactivation field of a deactivator provided at the particular frequency to trigger the deactivator to increase a power of the deactivation field as part of a tag deactivation process, and a gate field of a gate provided at the particular frequency to trigger a gate alarm;

wherein the deactivation sensor is configured to detect the increased power of the deactivation field, at the particular frequency, over a threshold and, in response, cause the sounder to be disabled.

14. The security device of claim 13 further comprising a tamper sensor;

wherein the tamper sensor is configured to detect a tamper event and, in response, cause the sounder to emit an alarm sound.

15. The security device of claim 14 wherein the tamper sensor is further configured to detect that an installation action has occurred and, in response, cause tamper detection circuitry to be armed.

16. The security device of claim 15 further comprising a light configured to be illuminated in response to the tamper detection circuitry being armed.

17. The security device of claim 14, wherein the tamper sensor is configured to detect the tamper event as a severing of a conductor that is electrically connected to the tamper sensor to form a loop.

18. The security device of claim 13, wherein the deactivation sensor comprises a resonant circuit.

19. The security device of claim 13, wherein the particular frequency is about 8.2 MHZ, 4.8 MHz, or 58 kHz.

20. The security device of claim 13, wherein the tag device is a non-deactivatable electronic article surveillance tag.

* * * * *